US009035937B2

(12) United States Patent
Kim et al.

(10) Patent No.: US 9,035,937 B2
(45) Date of Patent: May 19, 2015

(54) LIQUID CRYSTAL DISPLAY AND METHOD OF OPERATING THE SAME

(75) Inventors: Cheol-Min Kim, Yongin (KR); Joo-Hyung Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 648 days.

(21) Appl. No.: 12/986,014

(22) Filed: Jan. 6, 2011

(65) Prior Publication Data

US 2011/0234564 A1 Sep. 29, 2011

(30) Foreign Application Priority Data

Mar. 29, 2010 (KR) ..... 10-2010-0028084

(51) Int. Cl.
*G09G 5/00* (2006.01)
*G09G 3/36* (2006.01)

(52) U.S. Cl.
CPC ..... *G09G 3/3655* (2013.01); *G09G 3/3614* (2013.01); *G09G 2300/043* (2013.01); *G09G 2300/0443* (2013.01); *G09G 2320/0214* (2013.01); *G09G 2330/021* (2013.01)

(58) Field of Classification Search
USPC ..... 345/100, 204, 205
See application file for complete search history.

(56) References Cited

U.S. PATENT DOCUMENTS

| | | | | |
|---|---|---|---|---|
| 5,929,464 | A | 7/1999 | Yamazaki et al. | |
| 6,356,253 | B2 | 3/2002 | Uchino et al. | |
| 7,443,372 | B2 * | 10/2008 | Lee et al. | 345/96 |
| 2009/0040202 | A1 * | 2/2009 | Park | 345/204 |
| 2009/0128527 | A1 * | 5/2009 | Itakura et al. | 345/205 |
| 2009/0262061 | A1 * | 10/2009 | Chung et al. | 345/100 |

FOREIGN PATENT DOCUMENTS

| | | | |
|---|---|---|---|
| JP | 2003-330425 | A | 11/2003 |
| JP | 2006-178435 | A | 7/2006 |
| JP | 2006-189473 | A | 7/2006 |
| JP | 2007-086744 | A | 4/2007 |
| JP | 2008-158244 | A | 7/2008 |
| KR | 10-1996-0030449 | A | 8/1996 |
| KR | 10-0507261 | B1 | 8/2005 |
| KR | 10-2006-0044574 | A | 5/2006 |
| KR | 10-0816471 | B1 | 3/2008 |
| WO | WO 2004/090854 | A1 | 10/2004 |

OTHER PUBLICATIONS

Japanese Office Action dated Apr. 10, 2012 for Japanese Patent Application No. JP 2010-156120 which shares priority of Korean Patent Application No. KR 10-2010-0028084 with captioned U.S. Appl. No. 12/986,014.

(Continued)

*Primary Examiner* — Amare Mengistu
*Assistant Examiner* — Joseph G Rodriguez
(74) *Attorney, Agent, or Firm* — Knobbe Martens Olson & Bear LLP

(57) ABSTRACT

A liquid crystal display (LCD) is disclosed. The LCD has improved display quality and/or power consumption because current leakage in the pixels is effectively reduced.

21 Claims, 14 Drawing Sheets

(56) References Cited

OTHER PUBLICATIONS

Korean Office Action dated Jun. 17, 2011 for Korean Patent Application No. KR 10-2010-0028084 which corresponds to captioned U.S. Appl. No. 12/986,014.

Kimura et al., 18.2: A 2.15 inch QCIF Reflective Color TFT-LCD with Digital Memory on Glass (DMOG), SID 01 Digest, ISSN/0001-0966X/01/3201-0268-$1.00+.00 © 2001, pp. 268-271.

* cited by examiner

LIQUID CRYSTAL DISPLAY AND METHOD OF OPERATING THE SAME

CROSS-REFERENCE TO RELATED APPLICATIONS

This application claims priority to and the benefit of Korean Patent Application No. 10-2010-0028084 filed in the Korean Intellectual Property Office on Mar. 29, 2010, the entire contents of which are incorporated herein by reference.

BACKGROUND

1. Field

The disclosed technology relates to a liquid crystal display (LCD) and a driving method thereof. More particularly, it relates to a liquid crystal display (LCD) and a driving method thereof to minimize leakage current and to reduce power consumption.

2. Description of the Related Technology

As a representative display device, a liquid crystal display (LCD) includes two display panels with pixel electrodes, a common electrode, and a liquid crystal layer having dielectric anisotropy interposed between the two panels. The pixel electrodes are arranged in a matrix format and are connected to a switch such as a thin film transistor (TFT) to sequentially receive a data voltage row by row. The common electrode is formed over the entire surface of the display panel to convey a common voltage. Together, the pixel electrodes, the common electrode, and the liquid crystal layer interposed between the pixel electrodes and the common electrode, form a liquid crystal capacitor, the liquid crystal capacitor and a switch connected thereto are a basic unit forming a pixel.

In an LCD, an electric field is generated in the liquid crystal layer by applying voltages to the two electrodes, and transmittance of light passing through the liquid crystal layer is controlled by driving the electric field to thereby display a desired image. In order to reduce circuit aging effects caused by the lengthy application of an electric field in one direction to the liquid crystal layer, the polarity of the data voltage with respect to the common voltage is inverted for respective frames, respective rows, or respective pixels.

So-called leakage current occurs in the pixels of an LCD This can cause a reduction in image quality such as a luminance change, a lined-pattern, and crosstalk. The leakage current flows when the switching transistor transmitting the data signal to the pixel is not completely turned-off, and as a result, an undesired data signal is applied to the pixel. For example, to input the data signal to the plurality of pixels, the gate electrodes of the switching transistors in the row direction are sequentially applied with a scan signal to transmit the data signals to the corresponding pixels. However if the leakage current flows through the turned-off switching transistors, it can prematurely age the pixels connected to the switching transistors, and thereby harm image quality.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a liquid crystal display (LCD). The LCD includes a liquid crystal panel including a plurality of pixels configured to be driven during a scan period with data signals, where during a sustain period the pixels are configured to emit light according to the data signals. The LCD also includes a data driver configured to apply the data signals to the plurality of pixels, and a scan driver configured to apply scan signals controlling the input of the data signals, where the pixels are configured to receive a common voltage during the sustain period, and where the data driver is configured to apply the data signals during the scan period, and to apply a voltage opposite the common voltage to the plurality of pixels during the sustain period.

Another inventive aspect is a method of driving a liquid crystal display (LCD), the method including during a scan period, applying data signals to a plurality of data lines connected to a plurality of pixels, and during a sustain period, emitting light with the pixels according to the data signals. The method also includes applying a common voltage to the pixels, and during the sustain period, applying a voltage opposite the common voltage to the plurality of data lines.

DETAILED DESCRIPTION OF CERTAIN INVENTIVE EMBODIMENTS

Figure 1:
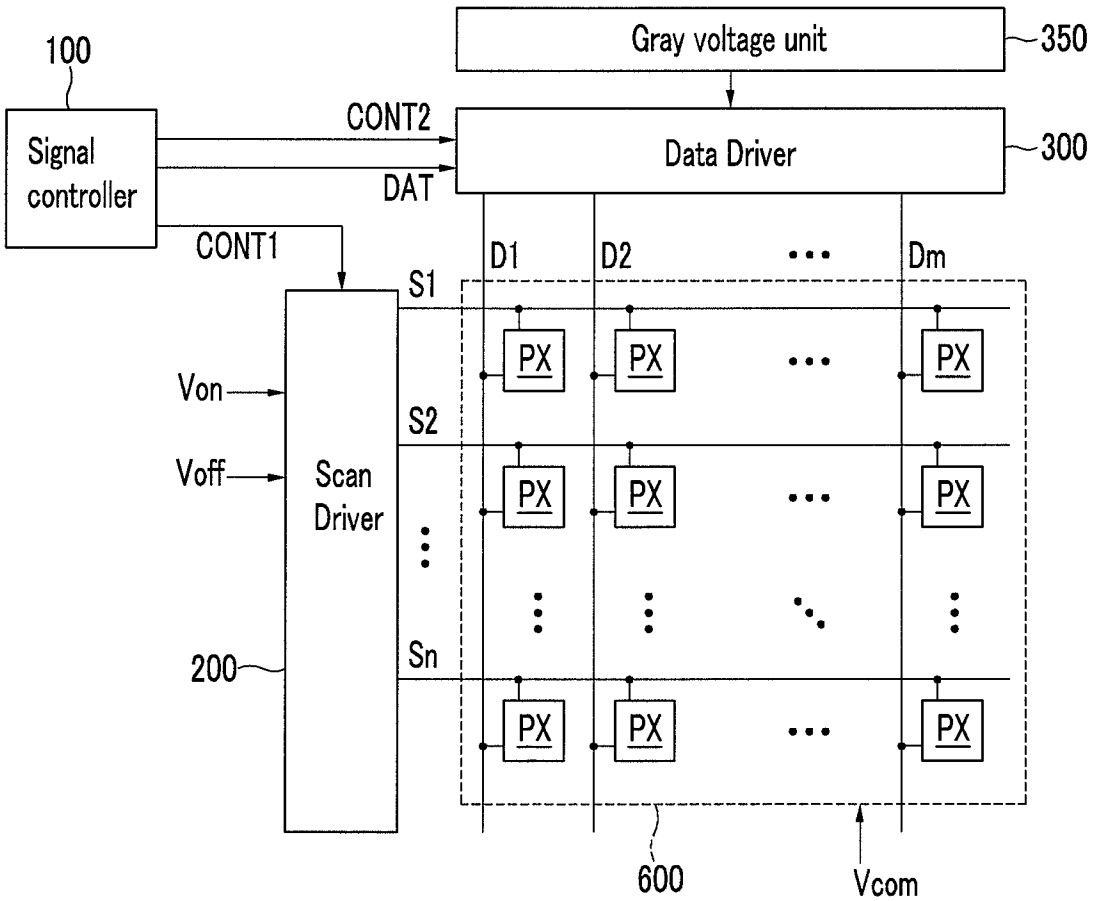
FIG. 1 is a block diagram of a liquid crystal display (LCD) according to an exemplary embodiment.

Certain inventive embodiments and aspects will be described more fully hereinafter with reference to the accompanying drawings, in which exemplary embodiments of the invention are shown. As those skilled in the art would realize, the described embodiments may be modified in various ways.

Furthermore, with exemplary embodiments, a detailed description is given as to the constituent elements of the embodiments with reference to the relevant drawings generally using the same reference numerals for the same constituent elements.

Parts that are irrelevant to the description may be omitted, and like reference numerals generally designate like elements throughout the specification.

Throughout this specification and the claims that follow, in some instances, when it is described that an element is "coupled" to another element, the element may be "directly coupled" to the other element or "indirectly coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a liquid crystal display (LCD) according to an exemplary embodiment.

Referring to FIG. 1, the liquid crystal display (LCD) includes a liquid crystal panel assembly 600, a scan driver 200 and a data driver 300 connected thereto, a gray voltage generator 350 connected to the data driver 300, and a signal controller 100 controlling the drivers.

The liquid crystal panel assembly 600 includes a plurality of scan lines S1-Sn, a plurality of data lines D1-Dm, and a plurality of pixels PX. The pixels PX are connected to the plurality of signal lines 1-Sn and D1-Dm and arranged in an approximate matrix. The scan lines S1-Sn extend in an approximate row direction and are substantially parallel to each other. The data lines D1 to Dm extend in a column direction and are substantially parallel to each other. At least one polarizer (not shown) polarizing light is attached, for example, to an outer surface of the liquid crystal panel assembly 600.

The signal controller 100 receives video signals R, G, and B and input control signals for controlling display of the input video signals, for example, from an external device. The input control signals may, for example, include a vertical synchronization signal Vsync, a horizontal synchronization signal Hsync, a main clock signal MCLK, and a data enable signal DE. The signal controller 100 provides an image data signal DAT and a data control signal CONT2 to the data driver 300. The data control signal CONT2 is a signal controlling the operation of the data driver and includes a horizontal synchronization start signal STH that notifies the transmission start of the image data signal DAT, a load signal LOAD, and a data clock signal HCLK for instruction of application of the data signal to the data lines D1-Dm. The data control signal CONT2 may further include a reversal signal RVS that inverts the polarity of a voltage of the data signal with respect to the common voltage Vcom.

The signal controller 100 provides the scan control signal CONT1 to the scan driver 200. The scan control signal CONT1 includes a scan start signal STV that instructs the start of a scan, and at least one clock signal controlling an output of a gate-on voltage Von. The scan control signal CONT1 may further include an output enable signal OE that limits the duration of the gate-on voltage Von.

The scan driver 200 is connected to the plurality of scan lines S1 to Sn of the liquid crystal display panel assembly 600 to apply a scan signal to the plurality of scan lines S1 to Sn. The scan signal a gate-on voltage Von that turns on the switching switch (M1 of FIG. 2) and a gate-off voltage Voff that that turns off the switching switch M1.

The data driver 300 is connected to the data lines D1-Dm of the liquid crystal panel assembly 600, and selects a gray voltage generated in the gray voltage generator 350. The data driver 300 applies the selected gray voltage as the data signal to the plurality of data lines D1-Dm. The gray voltage generator 350 may provide a predetermined number of reference gray voltages rather than providing voltages for all the gray levels, and the data driver 300 may generate gray voltages for all the gray levels by dividing the reference gray voltages and selecting a data voltage Vdat corresponding to the data signal.

Each of the above-mentioned driving apparatus 200, 300, and 350 may be directly mounted on the liquid crystal display panel assembly 300 in the form of at least one IC chip, may be mounted on a flexible printed circuit film (not shown) and then mounted on the liquid crystal panel assembly 300 in the form of a tape carrier package (TCP), or may be mounted on a separate printed circuit board (not shown). Alternatively, the drivers 200, 300, and 350 may be integrated with the liquid crystal display panel assembly 600 together with, for example, the signal lines S1-Sn and D1-Dm.

Figure 2:
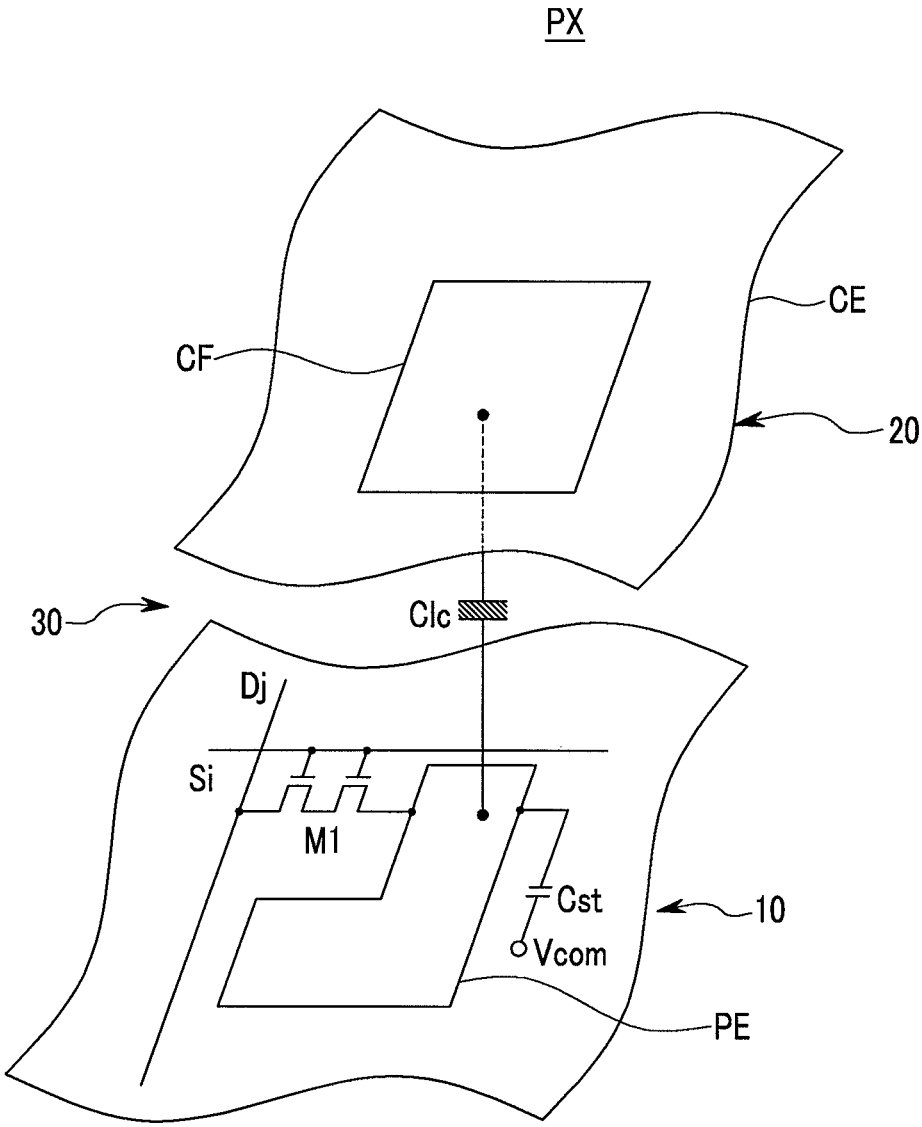
FIG. 2 is schematic view of a circuit of one pixel of FIG. 1.

FIG. 2 is a schematic diagram of a circuit of one pixel of FIG. 1.

Referring to FIG. 2, the liquid crystal panel assembly 600 includes a thin film transistor array panel 10 and a common electrode panel 20 facing each other, a liquid crystal layer 30 interposed therebetween, and a spacer (not shown) forming a gap between the two panels 10 and 20 and that is compressed to some degree.

Referring to pixel PX of the liquid crystal panel assembly 600, the pixel PX is connected to the i-th ($1 \leq i \leq n$) scan line Si and the j-th ($1 \leq j \leq m$) data line Dj, and includes a switching transistor M1, a liquid crystal capacitor Clc, and a sustain capacitor Cst connected thereto.

The liquid crystal capacitor Clc includes a pixel electrode PE of the thin film transistor array panel 10 and the common electrode CE of the common electrode panel 20 facing the thin film transistor array panel 10. That is, the liquid crystal capacitor Clc has the pixel electrode PE of the thin film transistor array panel 10 and the common electrode CE of the common electrode display panel 20 as two terminals and as two plates, and the liquid crystal layer 30 between the pixel electrode PE and the common electrode CE is a dielectric material.

The pixel electrode PE is connected to the switching transistor M1, and the common electrode CE is formed on the surface of the common electrode panel 20 over all the pixels and receives a common voltage Vcom. On the other hand, the common electrode CE may be provided on the thin film transistor array panel 10. In this case, at least one of two electrodes PE and CE may be made in the form of a line or a bar. The common voltage Vcom may alternately have two levels as a frame unit, a line unit, and a dot unit according to the inversion driving type of the liquid crystal display (LCD).

The switching transistor M1 as a three terminal element such as a thin film transistor provided in the thin film transistor array panel 10 includes a gate electrode connected to the scan line Si, an input terminal connected to the data line Dj, and an output terminal connected to the pixel electrode PE of the liquid crystal capacitor Clc. Here, the thin film transistor may, for example, include amorphous silicon or polycrystalline silicon.

The sustain capacitor Cst includes one terminal connected to the pixel electrode PE and the other terminal connected to the common voltage Vcom. A wire for the common voltage Vcom is formed to connect the common electrode CE and the sustain capacitor, or may be formed with an additional electrode to transmit the common voltage Vcom to the sustain capacitor Cst.

A color filter CF may be formed on a portion of the region of the common electrode CE of the common electrode panel 20. In order to realize color display, each pixel PX uniquely displays one of a set of primary colors (spatial division), or each pixel PX temporally and alternately displays primary colors (temporal division). Accordingly, the primary colors are spatially or temporally synthesized, and a desired color is generated. An example of the set of primary colors may be three primary colors of red, green, and blue.

Figure 3:
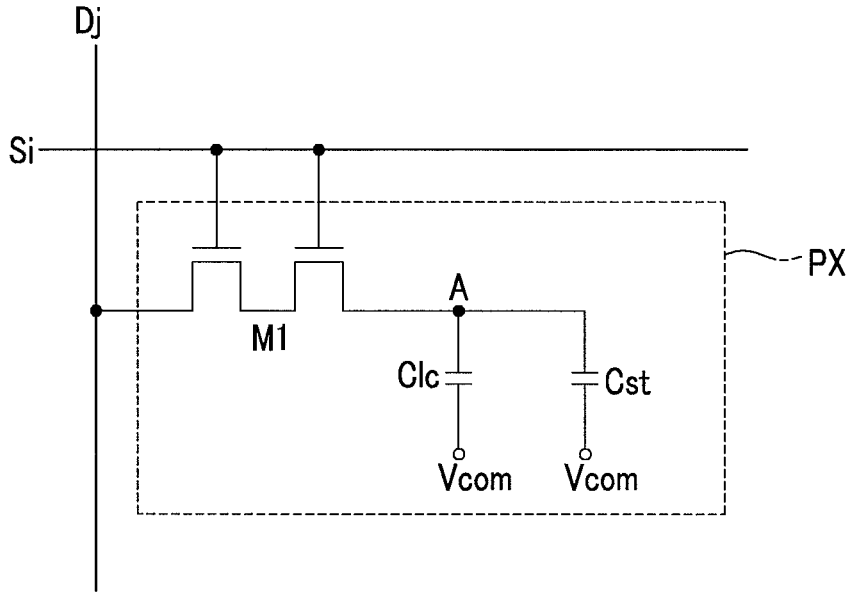
FIG. 3 is a circuit diagram of a pixel.

FIG. 3 is a circuit diagram to explain an operation of a liquid crystal display (LCD) of FIG. 1.

FIG. 3 shows the pixel PX connected to the i-th scan line Si and the j-th data line Dj.

If the scan line Si is applied with the gate-on voltage Von, the data voltage Vdat transmitted to the data line Dj is transmitted to the node A. The electric field is generated to the liquid crystal of the liquid crystal capacitor Clc according to the difference between the voltage of the node A and the common voltage Vcom, and the transmittance of light passing through the liquid crystal layer changes, thereby displaying images. As described above, the data signal is input to the pixel PX.

The operation of the liquid crystal display (LCD) according to an exemplary embodiment of the present invention is further described.

The liquid crystal display (LCD) according to an exemplary embodiment displays the images by using a frame including a scan period inputting the data voltage Vdat to the plurality of pixels PX and a sustain period in which the plurality of pixels PX maintains a light emitting state according to the data voltage Vdat input to each of the plurality of pixels PX. The frame includes a positive frame in which the data voltage Vdat has a voltage greater than the common voltage Vcom and a negative frame in which the data voltage Vdat has a voltage less than the common voltage Vcom. Also, the liquid crystal display (LCD) according to an exemplary embodiment may be driven by frame inversion and line (or row) inversion. The frame inversion is a driving method in which the data driver 300 generates the polarity of the data voltage according to the inversion signal RVS applied to each pixel PX so that the polarity of the current frame is opposite to the polarity of the previous frame. The line inversion is a driving method in which the polarity of the image data signal on one data line is periodically changed within one frame according to a characteristic of the inversion signal RVS, or the polarity of the image data signal applied to one pixel row may also be changed (a column inversion).

The operation of the liquid crystal display (LCD) according to an exemplary embodiment driven by the frame inversion is described with reference to FIGS. 1 to 4.

Figure 4:
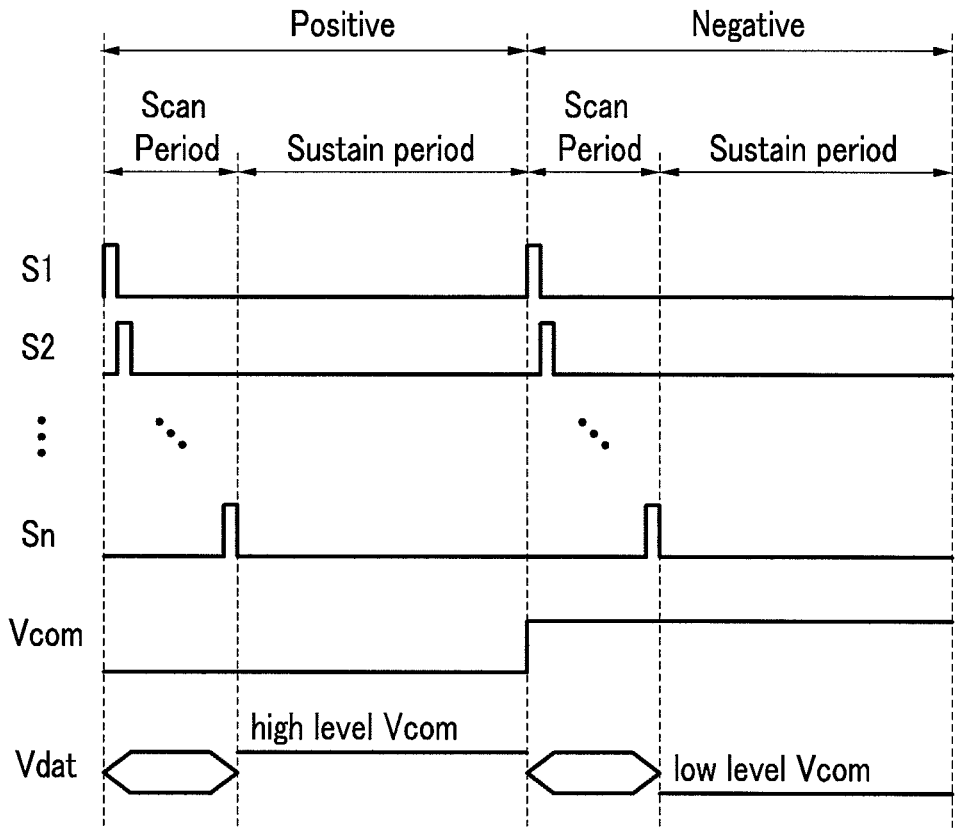
FIG. 4 is a timing diagram for a liquid crystal display (LCD) of FIG. 1, driven by frame inversion.

FIG. 4 is a timing diagram to explain an operation of a liquid crystal display (LCD) of FIG. 1, driven by frame inversion.

Referring to FIGS. 1 to 4, the signal controller 100 receives video signals R, G, and B input from an external device and input control signals for controlling display of the input video signals. The video signals R, G, and B include luminance information of each pixel PX, and the luminance has a predetermined number of gray levels, for example $1024=2^{10}$, $256=2^{8}$, or $64=2^{6}$. The input control signals exemplarily include a vertical synchronization signal (Vsync), a horizontal synchronization signal Hsync, a main clock signal MCLK, and a data enable signal DE.

The signal controller 100 processes the input video signals R, G, and B according to operation conditions of the liquid crystal display panel assembly 600 and the data driver 300 based on the input video signals R, G, and B and the input control signals, and generates a scan control signal CONT1 and a data control signal CONT2. The scan control signal CONT1 is provided to the scan driver 200. The data control signal CONT2 and a processed image data signal DAT are provided to the data driver 300. In some embodiments, the data driver 300 receives the image data signal DAT, and selects the gray level voltage corresponding to the image data signal DAT to convert the digital image data signal into an analog image data signal. The analog image data signal as the data signal input to each pixel PX is applied to the plurality of data lines D1-Dm.

Scan Period

The scan driver 200 sequentially applies the gate-on voltage Von to the plurality of scan lines S1-Sn according to the scan control signal CONT1 such that the switching transistor M1 connected to each of the scan lines S1-Sn is turned on.

The data driver 300 applies the plurality of data signals to the plurality of data lines D1-Dm for the plurality of pixels PX of one corresponding pixel row among the plurality of pixel rows according to the data control signal CONT2. The data signals applied to the plurality of data lines D1-Dm are applied to the corresponding pixels PX through the turned-on switching transistors M1. The data voltage Vdat is greater than the common voltage Vcom in the positive frame, and the data voltage Vdat is less than the common voltage Vcom in the negative frame.

In the frame inversion driving method, the common voltage Vcom has the voltage of the low level in the positive frame and has the voltage of the high level in the negative frame. For example, when the common voltage Vcom has the low level of 0V and the high level of 5V, the common voltage Vcom may be maintained as the predetermined voltage of 0V in the positive frame and may be maintained as the predetermined voltage of 5V in the negative frame. That is, the common voltage Vcom is changed to the voltage of the low level and the voltage of the high level in the frame inversion method. The above-described polarity means the sign of the difference of the data voltage with respect to the common voltage. That is, the data voltage has the voltage greater than the common voltage in the positive frame, and the data voltage has the voltage less than the common voltage during the negative frame. The charging voltage of the liquid crystal capacitor Clc is the magnitude of the difference between the common voltage Vcom and the data voltage Vdat regardless of the polarity such that the liquid crystal display (LCD) may be inverted with the frame unit and the line unit.

A difference between the data voltage Vdat and the common voltage Vcom is the charge voltage of the liquid crystal capacitor Clc, i.e., a pixel voltage. Liquid crystal molecules change their arrangement according to the magnitude of the pixel voltage so that polarization of light passing through the liquid crystal layer 30 changes. The change in the polarization is represented by a change in transmittance of light by the polarizer attached to the liquid crystal display panel assembly 300, whereby the pixel PX displays the desired images.

By repeating the process in units of one horizontal period (referred to as "1H", the same as one period of a horizontal synchronizing signal Hsync and a data enable signal DE), the gate-on voltage Von is sequentially applied to all scan lines S1-Sn and the image data signal is applied to all pixels PX so that an image of one frame is input according to the plurality of data voltages.

Sustain Period

The gate-off voltage Voff is applied to the plurality of scan lines S1-Sn, and the plurality of data lines D1-Dm are applied with a voltage opposite the common voltage Vcom. The opposite voltage means a voltage that has the largest difference from the common voltage Vcom among the range of the data voltage Vdat. The voltage opposite the common voltage Vcom means a voltage of the level opposite to the level of the common voltage Vcom. Also, the voltage opposite the common voltage Vcom may mean a voltage of the level in which the pixel PX of the liquid crystal display (LCD) of a normally black state corresponding to the common voltage Vcom becomes the white state.

For example, when the common voltage is the voltage of the low level of 0V, the opposite voltage means the voltage of the high level of 5V. When the common voltage is the voltage of the high level of 5V, the opposite voltage means the voltage of the low level of 0V. That is, the plurality of data lines D1-Dm are applied with the common voltage (high level Vcom) of the high level as the voltage opposite the common voltage Vcom during the sustain period in the positive frame, and the plurality of data lines D1-Dm are applied with the common voltage (low level Vcom) of the lower level as the voltage opposite the common voltage Vcom during the sustain period in the negative frame.

In the frame inversion method, the voltage opposite the common voltage Vcom is applied to the plurality of data lines D1-Dm during the sustain period so that the deterioration of the image quality due to the leakage current in the switching transistor M1 may be reduced. The operation of this pixel will be described.

For the liquid crystal display (LCD) according to an exemplary embodiment driven by the frame inversion, the operation of the pixel is described in the sustain period of the positive frame and the negative frame. In this example, the gate-off voltage Voff of the switching transistor M1 applied to the scan lines S1-Sn is −7V, the voltage of the low level of the common voltage Vcom is 0V, and the voltage of the high level is 5V.

Figure 5:
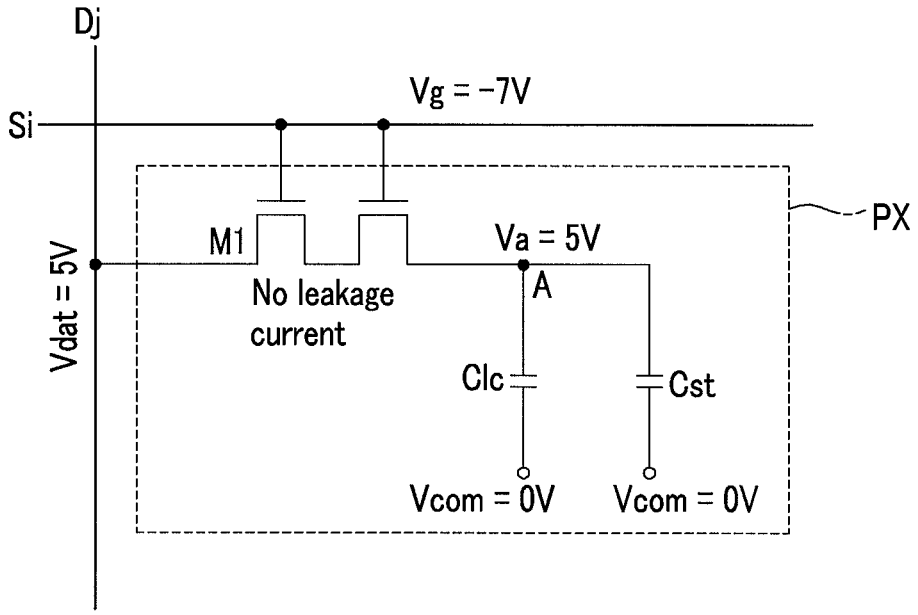
FIG. 5 is a circuit diagram of one pixel in a white state during a sustain period of the positive frame for the liquid crystal display (LCD) of FIG. 1, driven by frame inversion.

FIG. 5 is a circuit diagram of one pixel in a white state during a sustain period of the positive frame for the liquid crystal display (LCD) of FIG. 1, driven by frame inversion.

Referring to FIG. 5, in the positive frame, the common voltage Vcom is 0V, and the voltage Va of the node A of the pixel PX of the white state is 5V. During the sustain period, the scan line Si is applied with the gate-off voltage Voff of −7V, and the data line Dj is applied with the data voltage Vdat of 5V as the voltage opposite the common voltage Vcom.

The voltage of the data line Dj and the voltage of the node A are equal to each other as 5V such that the voltage difference between the input terminal and the output terminal of the switching transistor M1 is 0V. Accordingly, leakage current does not flow in the switching transistor M1. That is, if the plurality of data lines D1-Dm are applied with the voltage opposite the common voltage Vcom during the sustain period of the positive frame, the pixel PX of the white state is not influenced by the leakage current.

Figure 6:
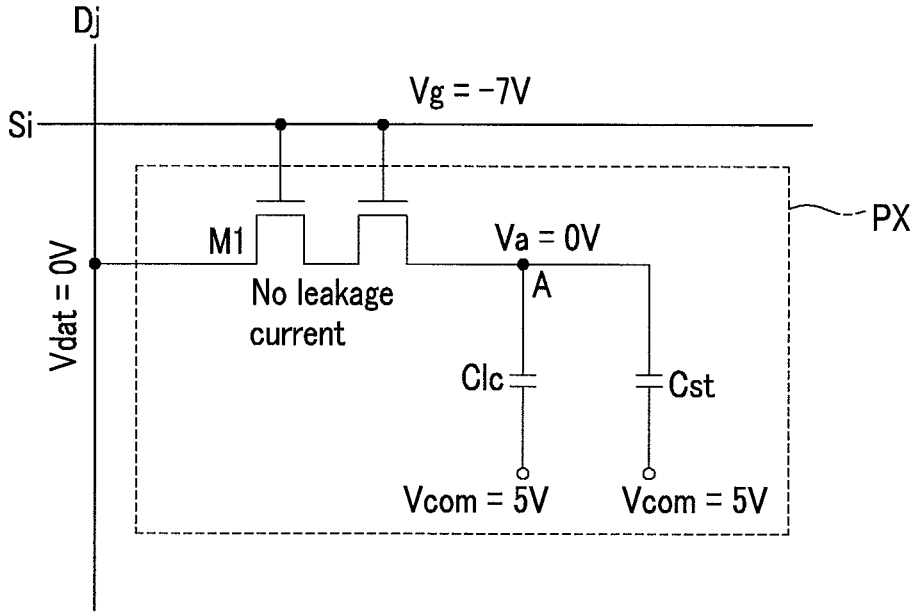
FIG. 6 is a circuit diagram of one pixel in a white state during a sustain period of a negative frame for the liquid crystal display (LCD) of FIG. 1, driven by frame inversion.

FIG. 6 is a circuit diagram of one pixel in a white state during a sustain period of a negative frame for the liquid crystal display (LCD) of FIG. 1, driven by frame inversion.

Referring to FIG. 6, in the negative frame, the common voltage Vcom is 5V, and the voltage Va of the node A of the pixel PX of the white state is 0V. During the sustain period, the scan line Si is applied with the gate-off voltage Voff of −7V, the data line Dj is applied with the data voltage Vdat of 0V as the voltage opposite the common voltage Vcom, and the voltage of the data line Dj and the voltage Va of the node A are equal to each other as 0V such that the voltage difference between the input terminal and the output terminal of the switching transistor M1 is 0V. Accordingly, leakage current does not flow in the switching transistor M1. That is, if the plurality of data lines D1-Dm are applied with the voltage opposite the common voltage Vcom during the sustain period of the negative frame, the pixel PX of the white state is not influenced by the leakage current.

Figure 7:
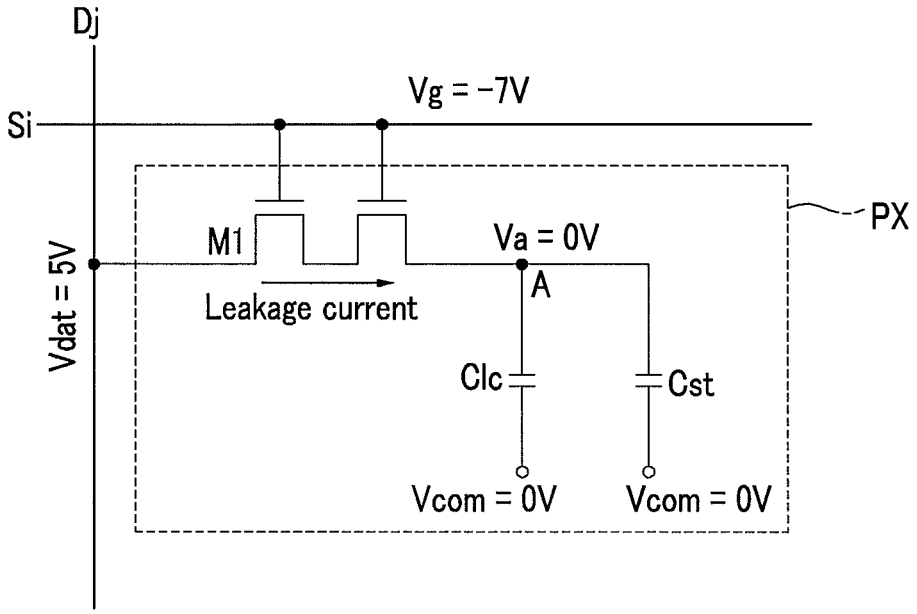
FIG. 7 is a circuit diagram of one pixel in a black state during a sustain period of a positive frame for the liquid crystal display (LCD) of FIG. 1, driven by frame inversion.

FIG. 7 is a circuit diagram of one pixel in a black state during a sustain period of a positive frame for the liquid crystal display (LCD) of FIG. 1, driven by frame inversion.

Referring to FIG. 7, in the positive frame, the common voltage Vcom is 0V, and the voltage Va of the node A of the pixel PX of the black state is 0V. During the sustain period, the scan line Si is applied with the gate-off voltage Voff of −7V, the data line Dj is applied with the data voltage Vdat of 5V as the voltage opposite the common voltage Vcom, and the voltage of the data line Dj is 5V and the voltage Va of the node A is 0V such that the voltage difference between the input terminal and the output terminal of the switching transistor M1 is 5V. Accordingly, leakage current may flow in the switching transistor M1 because of the voltage difference. That is, if the voltage opposite the common voltage Vcom is applied to the plurality of data lines D1-Dm during the sustain period of the positive frame, the pixel PX of the black state may be influenced by the leakage current.

Figure 8:
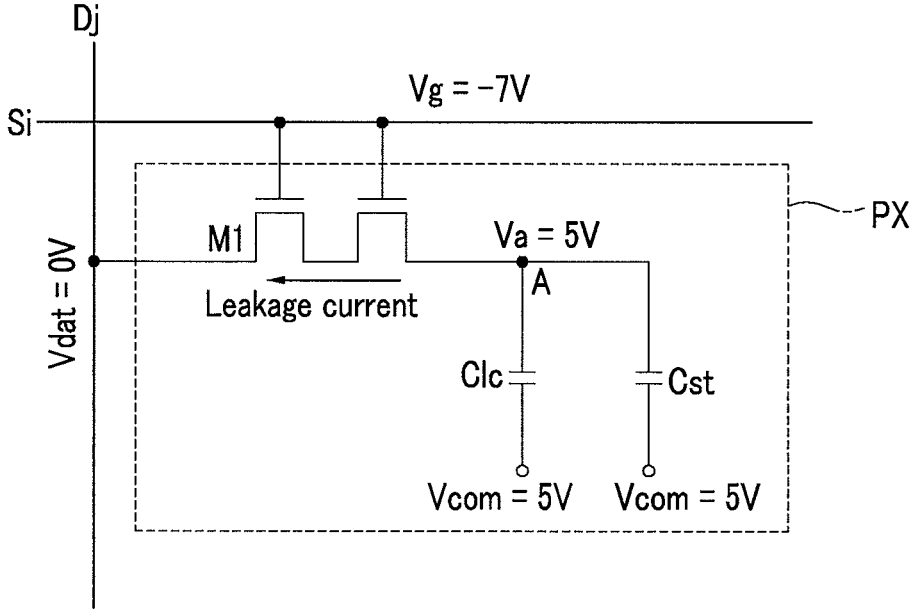
FIG. 8 is a circuit diagram of one pixel in a black state during a sustain period of a negative frame for the liquid crystal display (LCD) of FIG. 1, driven by frame inversion.

FIG. 8 is a circuit diagram of one pixel in a black state during a sustain period of a negative frame for the liquid crystal display (LCD) of FIG. 1, driven by frame inversion.

Referring to FIG. 8, in the negative frame, the common voltage Vcom is 5V, and the voltage Va of the node A of the pixel PX of the black state is 5V. During the sustain period, the scan line Si is applied with the gate-off voltage Voff of −7V, and the data line Dj is applied with the data voltage Vdat of 0V as the voltage opposite the common voltage Vcom.

The voltage of the data line Dj is 0V, and the voltage Va of the node A is 5V such that the voltage difference between the input terminal and the output terminal of the switching transistor M1 is 5V. Accordingly, leakage current may flow in the switching transistor M1 because of the voltage difference. That is, if the plurality of data lines D1-Dm are applied with the voltage opposite the common voltage Vcom during the sustain period of the negative frame, the pixel PX of the black state may be influenced by the leakage current.

The visibility of an observer is sensitive to a bright image like the white state, but is not sensitive to a dark image like the black state. If the voltage opposite the common voltage Vcom is applied to the plurality of data lines D1-Dm during the sustain period, the leakage current is not generated in the switching transistor M1 of the pixel PX in the white state, and the predetermined leakage current is generated only in the switching transistor M1 of the pixel PX in the black state. For example, in some embodiments, even though leakage current is generated in the pixel PX of the black state, the black state is sufficiently dark as long as the pixel voltage is in the range of 0-1.9V. Accordingly, the affect on perceived luminance of a pixel PX in the black state is less sensitive to leakage current than a pixel PX in the white state. Accordingly, the voltage opposite the common voltage Vcom is applied to the plurality of data lines D1-Dm during the sustain period such that the influence of the leakage current for the sensitive pixel PX in the bright image is minimized. Thus, the image quality deterioration is reduced.

Next, an operation of the liquid crystal display (LCD) according to an exemplary embodiment driven by line inversion is described with reference to FIG. 9. Some similar description as that of the operation of the frame inversion of FIG. 4 is omitted such that the differences will be emphasized.

Figure 9:
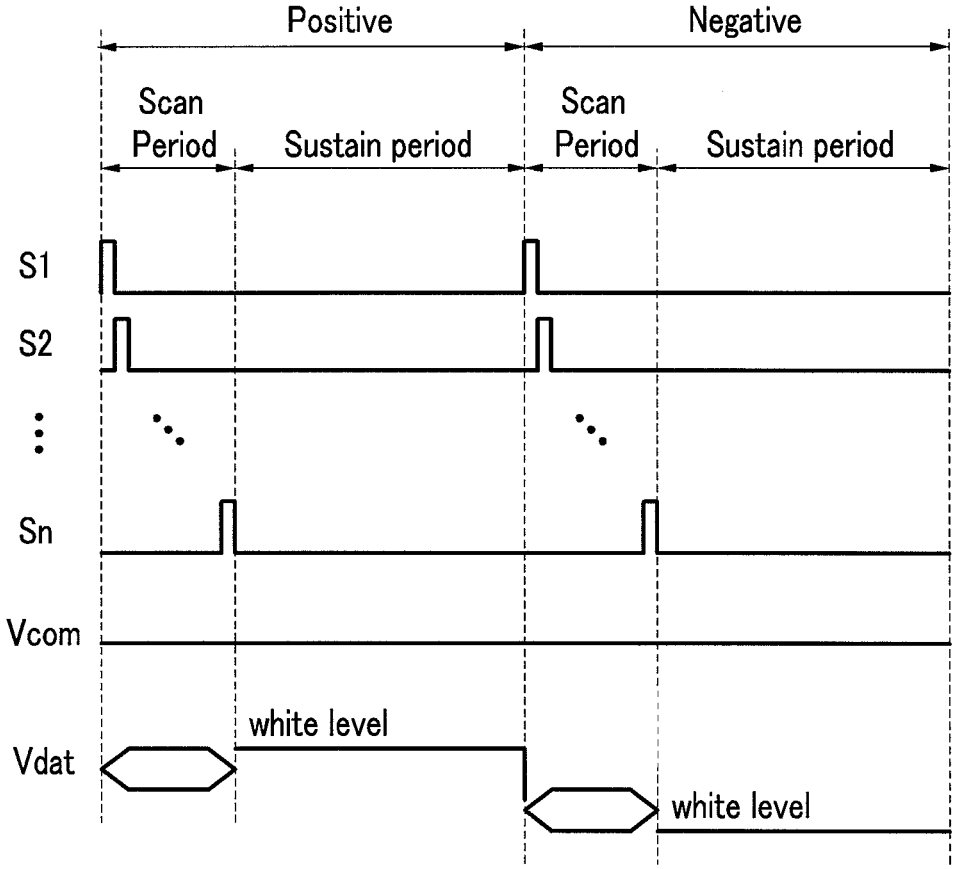
FIG. 9 is a timing diagram showing an operation of a liquid crystal display (LCD) of FIG. 1, driven by line inversion.

FIG. 9 is a timing diagram illustrating an operation of a liquid crystal display (LCD) of FIG. 1, driven by the line inversion driving method.

Referring to FIG. 9, the common voltage Vcom maintains the predetermined voltage in the line inversion. For example, the common voltage Vcom may maintain the predetermined voltage of 0V.

Scan Period

The scan driver 200 sequentially applies the gate-on voltage Von to the plurality of scan lines S1-Sn according to the scan control signal CONT1 such that the switching transistor M1 connected to each of the scan lines S1-Sn is turned on.

The data driver 300 applies the plurality of data signals to the plurality of data lines D1-Dm for the plurality of pixels PX of one corresponding pixel row among the plurality of pixel rows according to the data control signal CONT2 and the inversion signal RVS. The data driver 300 may apply the data signals through the column inversion.

In the case of the column inversion, the plurality of data signals having the different voltage polarity between the adjacent data lines are applied to the plurality of data lines D1-Dm in one frame. That is, one data line is applied with the positive data voltage Vdat of a level greater than the common voltage Vcom, and the adjacent data line is applied with the negative data voltage Vdat of a level less than the common voltage Vcom. For example, one data line may be applied with the data voltage Vdat of between 0 and 5V that is greater than the common voltage Vcom of 0V, and the adjacent data line may be applied with the data voltage Vdat of between −5 and 0V that is less than the common voltage Vcom of 0V. The pixel PX connected to the data line applied with the positive data voltage Vdat is operated according to the positive frame, and the pixel PX connected to the data line applied with the negative data voltage Vdat is operated according to the negative frame.

In the following frame, the negative data voltage Vdat is applied to the data line applied with the positive data voltage Vdat in the previous frame according to the inversion signal RVS, and the positive data voltage Vdat is applied to the data line applied with the negative data voltage Vdat in the previous frame. That is, the pixel PX operated according to the positive frame in the previous frame is operated according to the negative frame, and the pixel PX operated according to the negative frame in the previous frame is operated according to the positive frame.

Sustain Period

The plurality of scan lines S1-Sn are applied with the gate-off voltage Voff, and the plurality of data lines D1-Dm are applied with the white level voltage corresponding to the common voltage Vcom. The white level voltage corresponding to the common voltage Vcom means the voltage of the level in which the pixel PX becomes the white state corresponding to the common voltage Vcom. The voltage of the white level may be the white level voltage higher than the common voltage Vcom or less than the common voltage Vcom. For example, when the common voltage is 0V, the white level voltage may be the low white level voltage of −5V or the high white level voltage of 5V.

The data line applied with the positive data voltage Vdat during the scan period is applied with the high white level voltage during the sustain period. The data line applied with the negative data voltage Vdat during the scan period is applied with the low white level voltage during, the sustain period. That is, the high white level voltage is applied during the sustain period of the positive line, and the low white level voltage is applied during the sustain period of the negative line.

The plurality of data lines D1-Dm are applied with the white level voltage during the sustain period in the line inversion such that the deterioration of the image quality due to the leakage current that may be generated in the switching transistor M1 may be reduced. The operation of this pixel is described.

For the liquid crystal display (LCD) driven by the line inversion, the operation of the pixel is described in the sustain period of the positive line applied with the data voltage Vdat higher than the common voltage Vcom and the negative line applied with the data voltage Vdat lower than the common voltage Vcom. In this example, the gate-off voltage Voff of the switching transistor M1 applied to the scan lines S1-Sn is −7V, and that the common voltage Vcom is 0V. Here, the operation of the pixel in the white state in the sustain period of the positive line is substantially the same as the exemplary embodiment of FIG. 5, and the operation of the pixel of the black state in the sustain period of the positive line is substantially the same as the exemplary embodiment of FIG. 7. The operation of the pixel of the white state and the black state are described in the sustain period of the negative line with reference to FIGS. 10 and 11, respectively.

Figure 10:
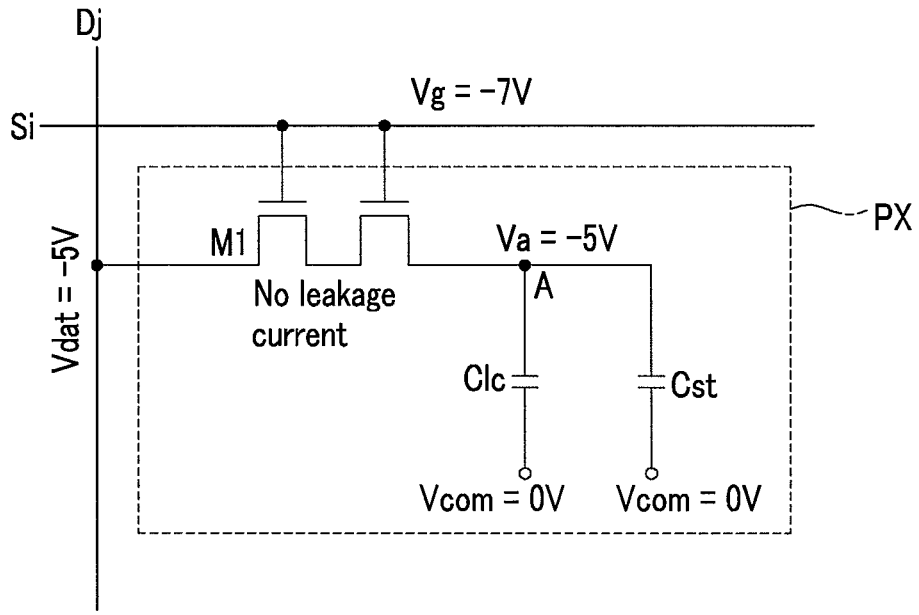
FIG. 10 is a circuit diagram of one pixel in a white state during a sustain period of a negative frame for the liquid crystal display (LCD) of FIG. 1, driven by line inversion.

FIG. 10 is a circuit diagram of one pixel in a white state during a sustain period of the negative line for the liquid crystal display (LCD) of FIG. 1, driven by line inversion.

Referring to FIG. 10, in the negative line, the common voltage Vcom is 0V, and the voltage Va of the node A of the pixel PX of the white state is −5V. During the sustain period, the scan line Si is applied with the gate-off voltage Voff of −7V, and the data line Dj is applied with the data voltage Vdat of −5V as the low white level voltage.

The voltage of the data line Dj and the voltage of the node A are equal to each other as −5V such that the voltage difference between the input terminal and the output terminal of the switching transistor M1 is 0V. Accordingly, the leakage current does not flow in the switching transistor M1. That is, if the plurality of data lines D1-Dm are applied with the low white level voltage during the sustain period of the negative line, the pixel PX of the white state is not influenced by the leakage current.

Figure 11:
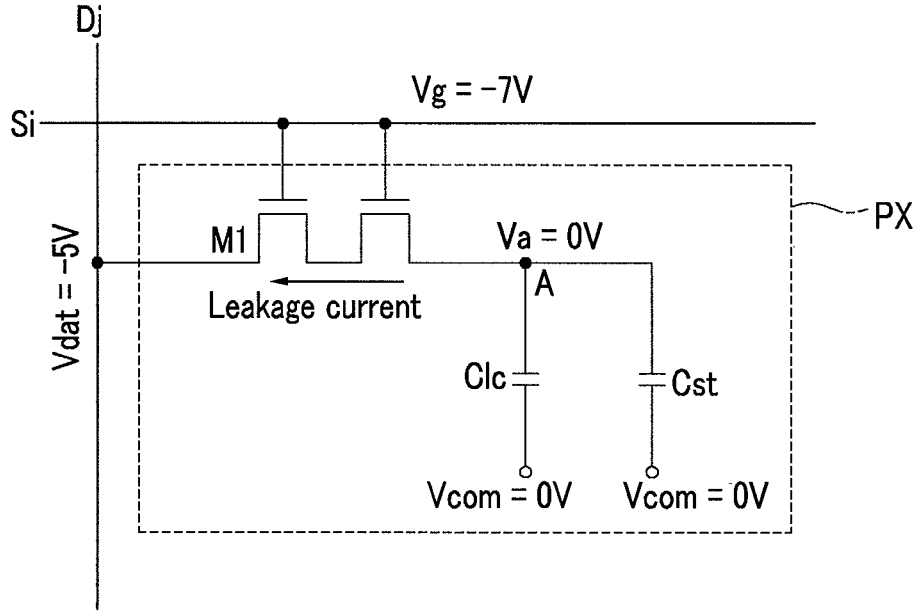
FIG. 11 is a circuit diagram of one pixel in a black state during a sustain period of a negative frame for the liquid crystal display (LCD) of FIG. 1, driven by line inversion.

FIG. 11 is a circuit diagram of one pixel of a black state during a sustain period of a negative line for the liquid crystal display (LCD) of FIG. 1 driven by line inversion.

Referring to FIG. 11, in the negative line, the common voltage Vcom is 0V, and the voltage Va of the node A of the pixel PX of the white state is 0V. During the sustain period, the scan line Si is applied with the gate-off voltage Voff of −7V, and the data line Dj is applied with the data voltage Vdat of −5V as the low white level voltage.

The voltage of the data line Dj is −5V and the voltage of the node A is 0V such that the voltage difference between the input terminal and the output terminal of the switching transistor M1 is 5V. Accordingly, the leakage current may flow in the switching transistor M1 because of the voltage difference. That is, if the low white level voltage is applied to the data line Dj during the sustain period of the negative line, the pixel PX of the black state may be influenced by the leakage current.

Although the leakage current is generated in the pixel PX of the black state, as discussed above, the black state is effectively displayed until the pixel voltage is in the range of 0-1.9V such that the image quality deterioration by the leakage current is insignificant.

As described above, after the plurality of pixels PX are applied with the data signal, the plurality of data lines D1-Dm are applied with the voltage opposite the common voltage Vcom or the white level voltage during the sustain period such that the leakage current of the pixel PX of the white state is minimized. However, the leakage current may be generated in the pixel PX of the black state, but has no significant or visible affect on the perceived image.

Next, a liquid crystal display (LCD) and a driving method thereof internally compensating a predetermined leakage current that may be generated in a pixel PX is described.

Figure 12:
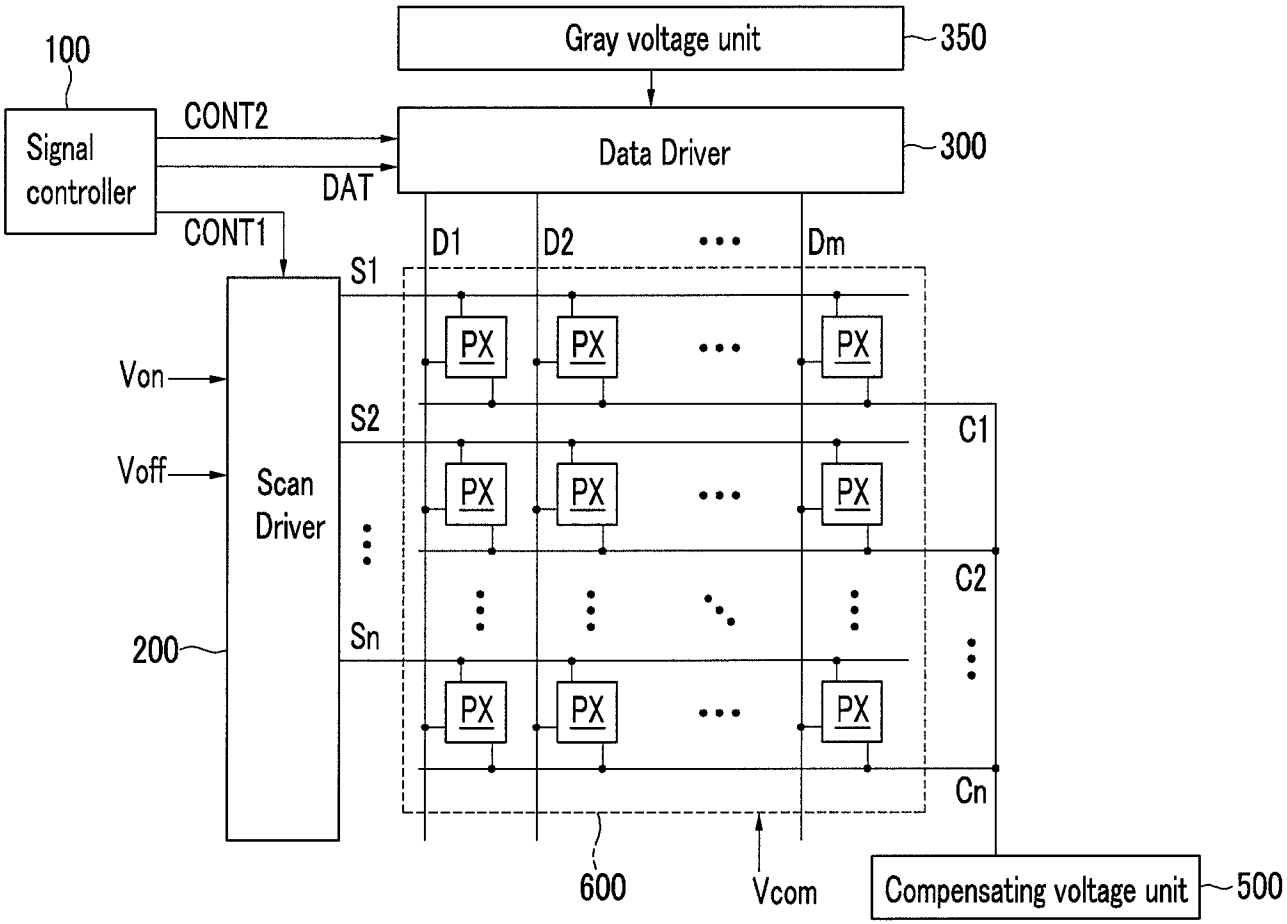
FIG. 12 is a block diagram of a liquid crystal display (LCD) according to another exemplary embodiment.

FIG. 12 is a block diagram of a liquid crystal display (LCD) according to another exemplary embodiment.

Referring to FIG. 12, the liquid crystal display (LCD) includes a liquid crystal panel assembly 600, a scan driver 200 and a data driver 300 connected thereto, a gray voltage generator 350 connected to the data driver 300, a compensation voltage unit 500, and a signal controller 100 controlling the drivers.

The liquid crystal panel assembly 600 includes a plurality of scan lines S1-Sn, a plurality of data lines D1-Dm, a plurality of compensating lines C1-Cn, and a plurality of pixels PX. The pixels PX are connected to the plurality of signal lines S1-Sn, D1-Dm, and C1-Cn, and are arranged in an approximate matrix. The scan lines S1-Sn extend in an approximate row direction and are substantially parallel to each other, and the compensating lines C1-Cn respectively correspond to each of the scan lines S1-Sn and extend in the approximate row direction. The data lines D1 to Dm extend in a column direction and are substantially parallel to each other. At least one polarizer (not shown) polarizing light is attached on, for example, an outer surface of the liquid crystal panel assembly 600.

The signal controller 100 receives video signals R, G, and B and input control signals for controlling a display of the input video signals from an external device. The input control signals may, for example, include a vertical synchronization signal Vsync, a horizontal synchronization signal Hsync, a main clock signal MCLK, and a data enable signal DE. The signal controller 100 provides a, image data signal DAT and a data control signal CONT2 to the data driver 300. The data control signal CONT2 is a signal controlling the operation of the data driver and includes a horizontal synchronization start signal STH that notifies the transmission start of the image data signal DAT, a load signal LOAD, and a data clock signal HCLK for instruction of application of the data signal to the data lines D1-Dm. The data control signal CONT2 may further include a reversal signal RVS that inverts the polarity of a voltage of the data signal with respect to the common voltage Vcom.

The signal controller 100 provides the scan control signal CONT1 to the scan driver 200. The scan control signal CONT1 includes a scan start signal STV that instructs the start of a scan, and at least one clock signal controlling an output of a gate-on voltage Von. The scan control signal CONT1 may further include an output enable signal OE that limits the duration of the gate-on voltage Von.

The scan driver 200 is connected to the plurality of scan lines S1 to Sn of the liquid crystal display panel assembly 600 to apply a scan signal to the plurality of scan lines S1 to Sn. The scan signal includes the gate-on voltage Von that turns on the switching switch (M2 of FIG. 13) and a gate-off voltage Voff that turns off the switching switch M2.

The data driver 300 is connected to the data lines D1-Dm of the liquid crystal panel assembly 600, and selects a gray voltage in the gray voltage generator 350. The data driver 300 applies the selected gray voltage as the data signal to the plurality of data lines D1-Dm. The gray voltage generator 350 may provide a predetermined number of reference gray voltages rather than providing voltages for all of the gray levels, and in this case, the data driver 300 may generate gray voltages for all the gray levels by dividing the reference gray voltages and selecting a data voltage Vdat corresponding to the data signal.

The compensation voltage unit 500 is connected to the plurality of compensating lines C1-Cn of the liquid crystal panel assembly 600, and is applied with the compensation voltage Vcompen such as the gate-off voltage Voff.

Each of the above-mentioned driving apparatus 200, 300, 350, and 500 may be directly mounted on the liquid crystal display panel assembly 300 in the form of at least one IC chip, may be mounted on a flexible printed circuit film (not shown) and then mounted on the liquid crystal panel assembly 300 in the form of a tape carrier package (TCP), or may be mounted on a separate printed circuit board (not shown). Alternatively, the drivers 200, 300, 350, and 500 may be integrated with the liquid crystal display panel assembly 600 together with, for example, the signal lines S1-Sn, C1-Cn, and D1-Dm.

Figure 13:
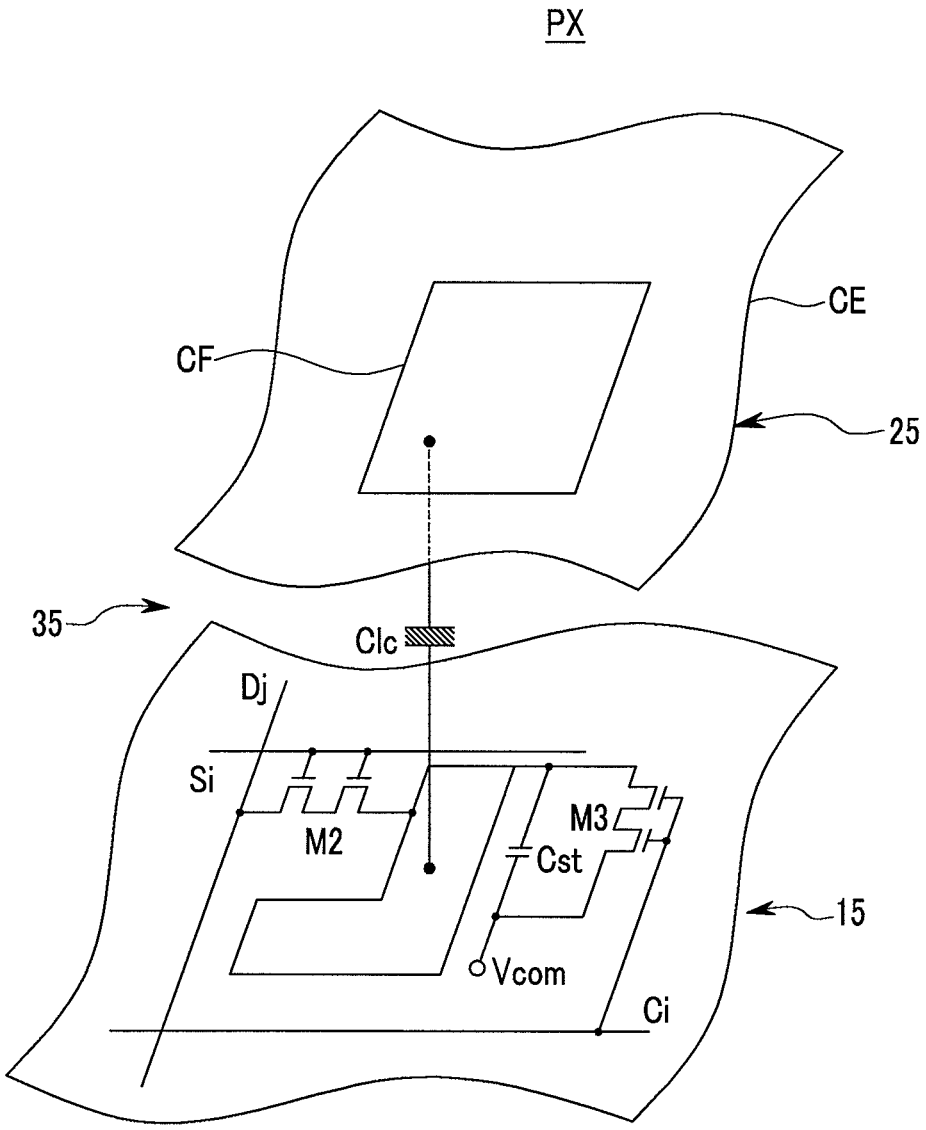
FIG. 13 is schematic view of a circuit of one pixel of FIG. 12.

FIG. 13 is a schematic diagram of a circuit of one pixel of FIG. 12.

Referring to FIG. 13, the liquid crystal panel assembly 600 includes a thin film transistor array panel 15 and a common electrode panel 25 facing each other, a liquid crystal layer 35 interposed therebetween, and a spacer (not shown) forming a gap between the two panels 15 and 25 and compressed to some degree.

Referring to one pixel PX of the liquid crystal panel assembly 600, the pixel PX connected to the i-th ($1 \le i \le n$) scan line Si and the j-th ($1 \le j \le m$) data line Dj includes a switching transistor M2, a liquid crystal capacitor Clc and a sustain capacitor Cst connected thereto, and a compensation transistor M3 connected thereto.

The liquid crystal capacitor Clc includes a pixel electrode PE of the thin film transistor array panel 15 and a common electrode CE of the common electrode panel 25 facing the thin film transistor array panel 15. That is, the liquid crystal capacitor Clc has the pixel electrode PE of the thin film transistor array panel 15 and the common electrode CE of the common electrode display panel 25 as two terminals or as two plates, and the liquid crystal layer 30 between the pixel electrode PE and the common electrode CE functions as a dielectric material.

The pixel electrode PE is connected to the switching transistor M2, and the common electrode CE is formed on the surface of the common electrode panel 25 over all the pixels and receives a common voltage Vcom. On the other hand, the common electrode CE may be provided on the thin film transistor array panel 15. In this case, at least one of the two electrodes PE and CE may be made in the form of a line or a bar. The common voltage Vcom is a uniform voltage of a predetermined level, and may be near about 0V.

The switching transistor M2 is a three terminal element such as a thin film transistor provided in the thin film transistor array panel 15 and includes a gate electrode connected to the scan line Si, an input terminal connected to the data line Dj, and an output terminal connected to the pixel electrode PE of the liquid crystal capacitor Clc. Here, the thin film transistor may, for example, include amorphous silicon or polycrystalline silicon.

The sustain capacitor Cst includes one terminal connected to the pixel electrode PE and the other terminal connected to the common voltage Vcom. A wire for the common voltage Vcom is formed to connect the common electrode CE and the sustain capacitor, or may be formed with an additional electrode to transmit the common voltage Vcom to the sustain capacitor Cst.

The compensation transistor M3 includes a gate terminal connected to the compensating line Ci, one terminal connected to the sustain capacitor Cst, and the other terminal connected to the common voltage Vcom. The compensating line Ci is applied with the predetermined compensation voltage Vcompen such as the gate-off voltage Voff applied to the scan line Si. The compensation voltage Vcompen is the gate-off voltage turning off the gate of the compensation transistor M3 such that the leakage current flowing in the switching transistor M2 flows in the compensation transistor M3 so that the pixel voltage across the liquid crystal capacitor Clc is not affected as much by the leakage current of the switching transistor. The leakage current flowing in the compensation transistor M3 is the compensation current compensating the leakage current of the switching transistor M2. The compensation voltage Vcompen is a voltage operating the compensation transistor M3 conduct the compensation current and has the voltage that is lower than the pixel voltage.

A color filter CF may be formed on a portion of the region of the common electrode CE of the common electrode panel 20. In order to realize color display, each pixel PX uniquely displays one of a set of primary colors (spatial division), or each pixel PX temporally and alternately displays primary colors (temporal division). Then, the primary colors are spatially or temporally synthesized, and thus a desired color is recognized. An example of the set of primary colors may be three primary colors of red, green, and blue.

Figure 14:
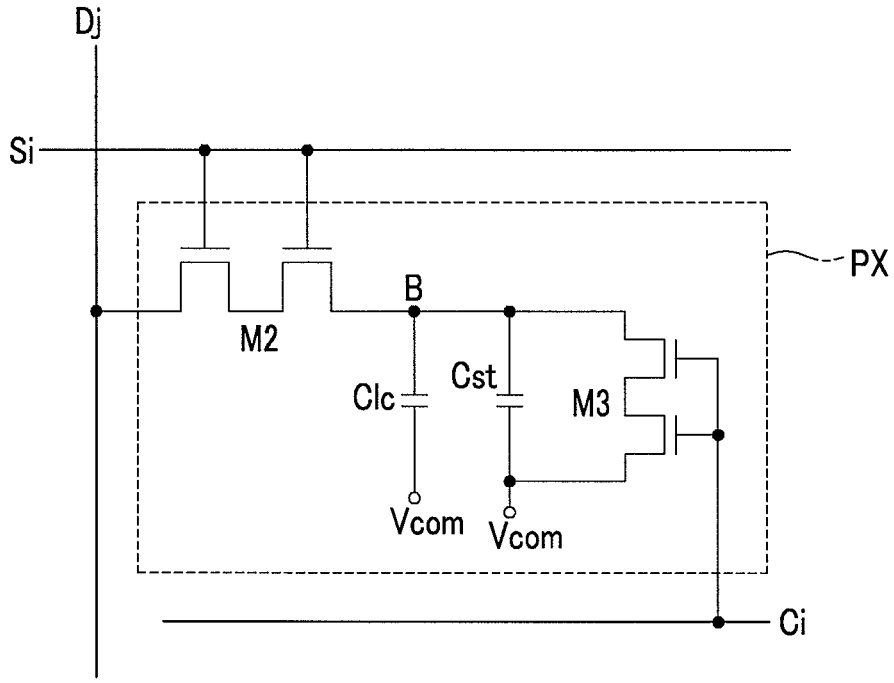
FIG. 14 is a circuit diagram of a pixel.

FIG. 14 is a circuit diagram of an embodiment of a liquid crystal display (LCD) of FIG. 12.

FIG. 14 shows the pixel PX connected to the i-th scan line Si and compensating line Ci, and the j-th data line Dj.

If the scan line Si is applied with the gate-on voltage Von, the data voltage Vdat on the data line Dj is transmitted to the node B. The electric field is generated to the liquid crystal of the liquid crystal capacitor Clc according to the difference between the voltage of the node B and the common voltage Vcom, and the transmittance of light passing through the liquid crystal layer changes, thereby displaying pixels of images. The compensating line Cj is applied with the gate-off voltage Voff, and the compensation transistor M3 is off during the time that the data signal is input to each pixel.

The operation of the liquid crystal display (LCD) of FIG. 12 according to an exemplary embodiment is described in detail. The liquid crystal display (LCD) displays the images by using frames, each including a scan period and a sustain period, and may be driven by the frame inversion and the line inversion.

The liquid crystal display (LCD) driven by the frame inversion may be operated according to the timing diagram shown in FIG. 4. The operation of the liquid crystal display (LCD) driven by the frame inversion is described with reference to FIGS. 12 to 14 and FIG. 4.

The signal controller 100 receives video signals R, G, and B input from an external device, and input control signals for controlling display of the input video signals. The video signals R, G, and B include luminance information of each pixel PX, and the luminance has a predetermined number of gray levels, for example $1024=2^{10}$, $256=2^{8}$, or $64=2^{6}$. The input control signals may, for example, include a vertical synchronization signal (Vsync), a horizontal synchronization signal Hsync, a main clock signal MCLK, and a data enable signal DE.

The signal controller 100 processes the input video signals R, G, and B for operation conditions of the liquid crystal display panel assembly 600 and the data driver 300 based on the input video signals R, G, and B and the input control signals, and generates a scan control signal CONT1 and a data control signal CONT2. The scan control signal CONT1 is provided to the scan driver 200. The data control signal CONT2 and a processed image data signal DAT are provided to the data driver 300.

In some embodiments, the data driver 300 receives the image data signal DAT, and selects the gray level voltage corresponding to the image data signal DAT to convert the digital image data signal into an analog image data signal. The analog image data signal as the data signal input to each pixel PX is applied to the plurality of data lines D1-Dm.

The compensation voltage unit 500 applies the compensation voltage Vcompen to the plurality of compensating lines C1-Cn during the scan period and the sustain period. The compensation voltage Vcompen may be a voltage maintaining the compensation transistor M3 in the off state, and may be the same voltage as the gate-off voltage Voff applied to the scan lines S1-Sn.

Scan Period

The scan driver 200 sequentially applies the gate-on voltage Von to the plurality of scan lines S1-Sn according to the scan control signal CONT1 such that the switching transistor M2 connected to each scan lines S1-Sn is turned on in sequence.

Here, the data driver 300 applies the plurality of data signals to the plurality of data lines D1-Dm for the plurality of pixels PX of one corresponding pixel row among the plurality of pixel rows according to the data control signal CONT2. The data signals applied to the plurality of data lines D1-Dm are applied to the corresponding pixels PX through the turned-on switching transistor M2. The data voltage Vdat has the voltage that is larger than the common voltage Vcom in the positive frame, and the data voltage Vdat has the voltage that is smaller than the common voltage Vcom in the negative frame.

In the frame inversion, the common voltage Vcom has the voltage of the low level in the positive frame, and has the voltage of the high level in the negative frame. For example, when the common voltage Vcom has the low level of 0V and the high level, of 5V the common voltage Vcom may be maintained as the predetermined voltage of 0V in the positive frame, and may be maintained as the predetermined voltage of 5V in the negative frame. That is, the common voltage Vcom is changed into the voltage of the low level and the voltage of the high level as the frame unit in the frame inversion.

The difference between the data voltage Vdat and the common voltage Vcom is the charge (or pixel) voltage of the liquid crystal capacitor Clc. Liquid crystal molecules change their arrangement according to the magnitude of the pixel voltage, so that polarization of light passing through the liquid crystal layer 30 changes. The change in the polarization is represented by the change in transmittance of light by the polarizer attached to the liquid crystal display panel assembly 300, such that the pixel PX displays the desired images.

By repeating the process in units of one horizontal period, the gate-on voltage Von is sequentially applied to all scan lines S1-Sn and the image data signal is applied to all pixels PX, so that an image of one frame is input according to the plurality of data voltages.

Sustain Period

The gate-off voltage Voff is applied to the plurality of scan lines S1-Sn and the plurality of compensating lines C1-Cn, and the plurality of data lines D1-Dm are applied with a voltage opposite the common voltage Vcom. The voltage opposite the common voltage Vcom may be the voltage of the level that is opposite the level of the common voltage Vcom or the voltage of the level in which the pixel PX is in the white state for the common voltage Vcom. For example, when the common voltage is the voltage of the low level of 0V, the opposite voltage means the voltage of the high level of 5V. When the common voltage is the voltage of the high level of 5V, the opposite voltage means the voltage of the low level of 0V. That is, the plurality of data lines D1-Dm are applied with the common voltage (high level Vcom) of the high level as the voltage opposite the common voltage Vcom during the sustain period in the positive frame, and the plurality of data lines D1-Dm are applied with the common voltage (low level Vcom) of the lower level as the voltage opposite the common voltage Vcom during the sustain period in the negative frame.

In the frame inversion, the compensating lines C1-Cn are applied with the gate-off voltage Voff, and the voltage opposite the common voltage Vcom is applied to the plurality of data lines D1-Dm during the sustain period such that the deterioration of the image quality due to the leakage current that may be generated in the switching transistor M2 may be reduced. The operation of this pixel will be described.

For the liquid crystal display (LCD) driven by the frame inversion, the operation of the pixel is described in the sustain period of the positive frame and the negative frame. It is assumed that the gate-off voltage Voff of the switching transistor M2 applied to the scan lines S1-Sn is −7V, the compensation voltage Vcompen applied to the compensating lines C1-Cn is −7V, the voltage of the low level of the common voltage Vcom is 0V, and the voltage of the high level is 5V.

Figure 15:
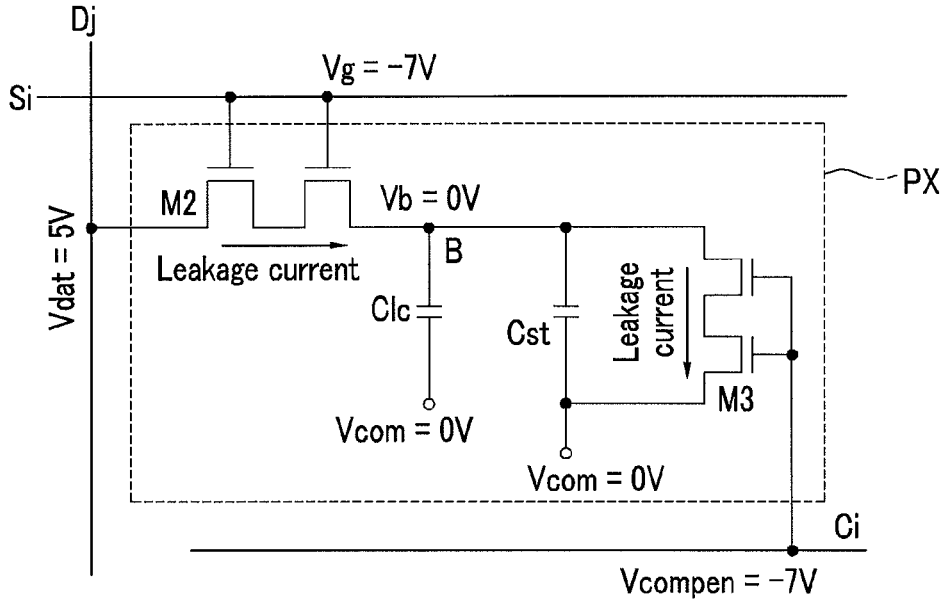
FIG. 15 is a circuit diagram of one pixel in a black state during a sustain period of the positive frame for the liquid crystal display (LCD) of FIG. 12, driven by frame inversion.

FIG. 15 is a circuit diagram of one pixel in a black state during a sustain period of the positive frame for the liquid crystal display (LCD) of FIG. 12, driven by frame inversion.

Referring to FIG. 15, in the positive frame, the common voltage Vcom is 0V, and the voltage Vb of the node B of the pixel PX of the black state is 0V. During the sustain period, the scan line Si is applied with the gate-off voltage Voff of −7V, the data line Dj is applied with the data voltage Vdat of 5V as the voltage opposite the common voltage Vcom, and the compensating line Ci is applied with the compensation voltage Vcompen of −7V.

The voltage of the data line Dj is 5V and the voltage Vb of the node B is 0V such that the voltage difference between the input terminal and the output terminal of the switching transistor M2 is 5V. Accordingly, the leakage current may flow toward the output terminal from the input terminal of the switching transistor M2 because of the voltage difference. The voltage Vb of the node B may be increased by the leakage current flowing in the switching transistor M2, however, if the voltage Vb of the node B is high, the leakage current toward the other terminal of the compensation transistor M3 from one terminal thereof is generated. Accordingly, the leakage current flowing in the switching transistor M2 is compensated by the leakage current flowing in the compensation transistor M3.

Figure 16:
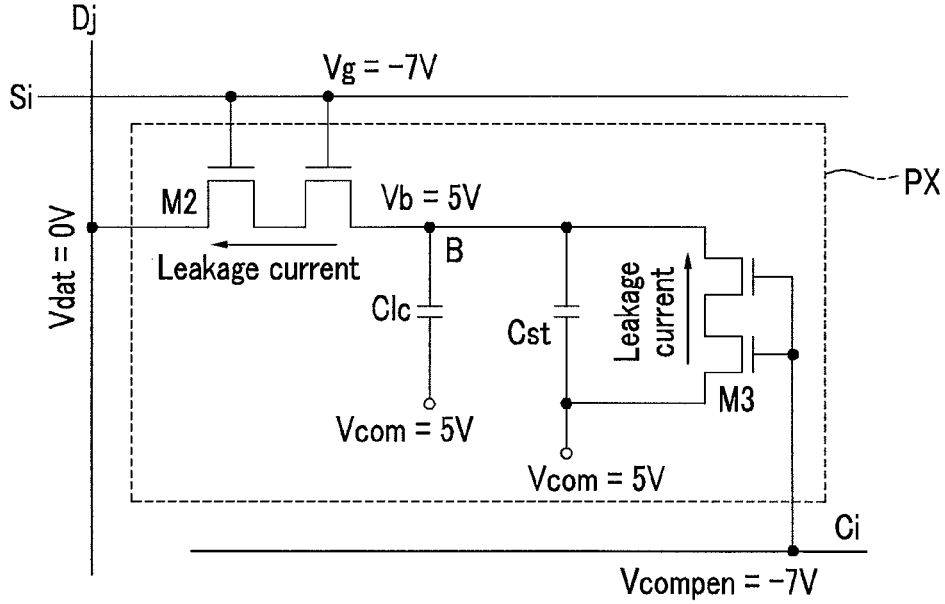
FIG. 16 is a circuit diagram of one pixel in a black state during a sustain period of the negative frame for the liquid crystal display (LCD) of FIG. 12, driven by frame inversion.

FIG. 16 is a circuit diagram of one pixel in a black state during a sustain period of a negative frame for the liquid crystal display (LCD) of FIG. 12, driven by frame inversion.

Referring to FIG. 16, in the negative frame, the common voltage Vcom is 5V, and the voltage Vb of the node B of the pixel PX of the black state is 5V. During the sustain period, the scan line Si is applied with the gate-off voltage Voff of −7V, the data line Dj is applied with the data voltage Vdat of 0V as the voltage opposite the common voltage Vcom, and the compensating line Ci is applied with the compensation voltage Vcompen of −7V.

The voltage of the data line Dj is 0V, and the voltage Vb of the node B is 5V such that the voltage difference between the input terminal and the output terminal of the switching transistor M2 is 5V. Accordingly, the leakage current may flow toward the input terminal from the output terminal of the switching transistor M2 because of the voltage difference. The voltage Vb of the node B may be decreased by the leakage current flowing in the switching transistor M2, however, if the voltage Vb of the node B is low, the leakage current toward one terminal of the compensation transistor M3 from the other terminal thereof is generated. Accordingly, the leakage current flowing in the switching transistor M2 is at least partly compensated by the leakage current flowing in the compensation transistor M3.

As described above, when the voltage opposite the common voltage Vcom is applied to the plurality of data lines D1-Dm during the sustain period of the positive frame or the negative frame, the leakage current that may flow in the pixel PX of the black state is compensated such that the image quality deterioration by the leakage current may be reduced.

Figure 17:
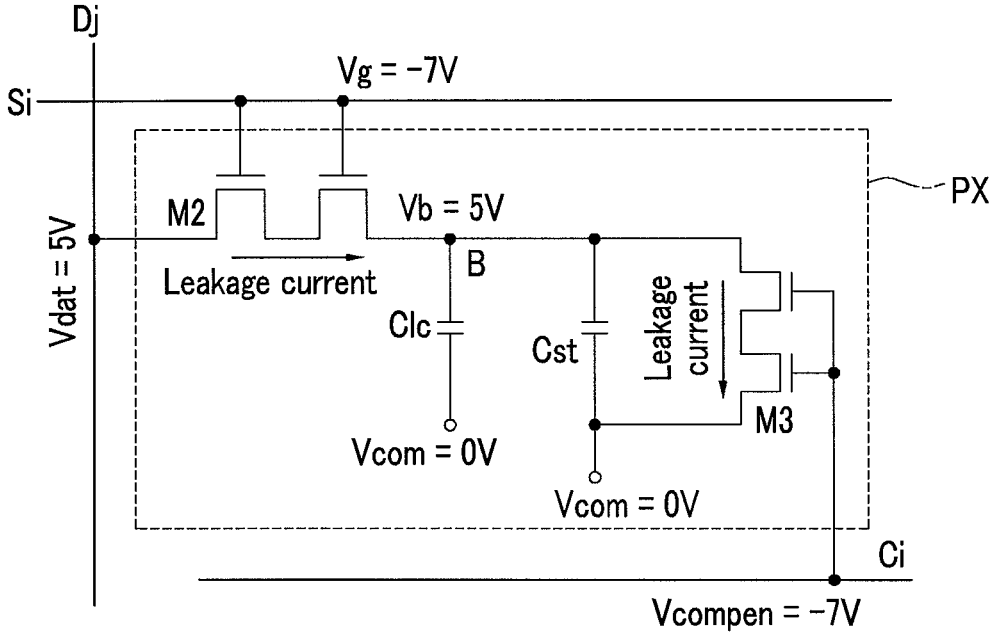
FIG. 17 is a circuit diagram of one pixel in a white state during a sustain period of the positive frame for the liquid crystal display (LCD) of FIG. 12, driven by frame inversion.

FIG. 17 is a circuit diagram of one pixel in a white state during a sustain period of a positive frame for the liquid crystal display (LCD) of FIG. 12, driven by frame inversion.

Referring to FIG. 17, in the positive frame, the common voltage Vcom is 0V, and the voltage Vb of the node B of the pixel PX of the white state is 5V. During the sustain period, the scan line Si is applied with the gate-off voltage Voff of −7V, the data line Dj is applied with the data voltage Vdat of 5V as the voltage opposite the common voltage Vcom, and the compensating line Ci is applied with the compensation voltage Vcompen of −7V.

The voltage of the data line Dj and the voltage Vb of the node B are equal to each other as 5V such that the voltage difference between the input terminal and the output terminal of the switching transistor M2 is 0V. Meanwhile, the voltage difference between one terminal and the other terminal of the compensation transistor M3 is 5V. Accordingly, the leakage current may flow toward the other terminal of the compensation transistor M3 from one terminal thereof by the voltage difference. The voltage Vb of the node B may be decreased by the leakage current flowing in the compensation transistor M3, however if the voltage Vb of the node B is low, the leakage current toward the node B from the data line Dj is generated in the switching transistor M2. Accordingly, the leakage current flowing in the compensation transistor M3 is compensated by the leakage current flowing in the switching transistor M2.

Figure 18:
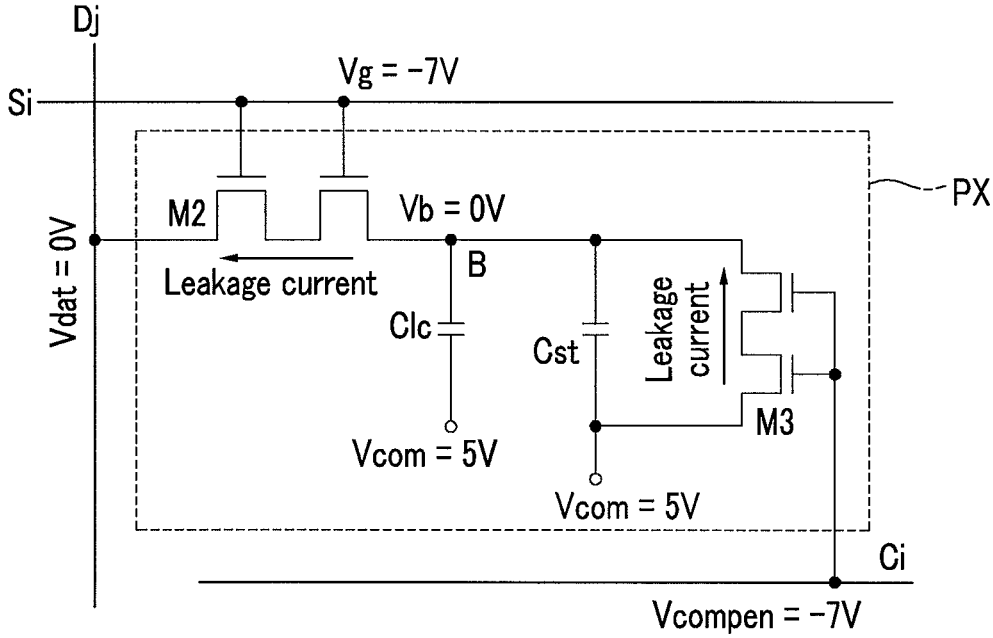
FIG. 18 is a circuit diagram of one pixel in a white state during a sustain period of the negative frame for the liquid crystal display (LCD) of FIG. 12, driven by frame inversion.

FIG. 18 is a circuit diagram of one pixel in a white state during a sustain period of a negative frame for the liquid crystal display (LCD) of FIG. 12, driven by frame inversion.

Referring to FIG. 18, in the negative frame, the common voltage Vcom is 5V, and the voltage Vb of the node B of the pixel PX of the white state is 0V. During the sustain period, the scan line Si is applied with the gate-off voltage Voff of −7V, the data line Dj is applied with the data voltage Vdat of 0V as the voltage opposite the common voltage Vcom, and the compensating line Ci is applied with the compensation voltage Vcompen of −7V.

The voltage of the data line Dj and the voltage Vb of the node B are equal to each other as 0V such that the voltage difference between the input terminal and the output terminal of the switching transistor M2 is 0V. Meanwhile, the voltage difference between one terminal and the other terminal of the compensation transistor M3 is 5V. Accordingly, the leakage current may flow toward one terminal of the compensation transistor M3 from the other terminal thereof because of the voltage difference. The voltage Vb of the node B may be increased by the leakage current flowing in the compensation transistor M3, however if the voltage Vb of the node B is high, the leakage current toward the data line Dj from the node B is generated in the switching transistor M2. Accordingly, the leakage current flowing in the compensation transistor M3 is compensated by the leakage current flowing in the switching transistor M2.

As described above, when the voltage opposite the common voltage Vcom is applied to the plurality of data lines D1-Dm during the sustain period of the positive frame or the negative frame, the leakage current corresponding to the leakage current flowing in the compensation transistor M3 in the pixel PX of the white state flows in the switching transistor M2 and is compensated such that the image quality is not so affected by the leakage current.

An operation of the liquid crystal display (LCD) according to another exemplary embodiment driven by line inversion is described with reference to FIGS. 12 to 14 as well as FIG. 9. The liquid crystal display (LCD) driven by the line inversion may be operated according to the timing diagram shown in FIG. 9. Some of the description of the operation of the line inversion in FIG. 9 is omitted such that the differences will be mainly described.

The common voltage Vcom always maintains the predetermined voltage in the line inversion. For example, the common voltage Vcom may maintain the predetermined voltage of 0V.

The compensation voltage unit 500 applies the compensation voltage Vcompen to the plurality of compensating lines C1-Cn during the scan period and sustain period. The compensation voltage Vcompen may be the voltage maintaining the compensation transistor M3 in the off state, and may be the same voltage as the gate-off voltage Voff applied to the scan lines S1-Sn.

Scan Period

The scan driver 200 sequentially applies the gate-on voltage Von to the plurality of scan lines S1-Sn according to the scan control signal CONT1 such that the switching transistor M1 connected to each of the scan lines S1-Sn is turned on.

Here, the data driver 300 applies the plurality of data signals to the plurality of data lines D1-Dm for the plurality of pixels PX of one corresponding pixel row among the plurality of pixel rows according to the data control signal CONT2 and the inversion signal RVS. The data driver 300 may apply the data signals through the column inversion.

Sustain Period

The plurality of scan lines S1-Sn are applied with the gate-off voltage Voff, and the plurality of data lines D1-Dm are applied with the white level voltage corresponding to the common voltage Vcom. The data line applied with the positive data voltage Vdat during the scan period is applied with the high white level voltage during the sustain period. The data line applied with the negative data voltage Vdat during the scan period is applied with the low white level voltage during the sustain period. That is, the high white level voltage is applied during the sustain period of the positive line, and the low white level voltage is applied during the sustain period of the negative line.

The plurality of data lines D1-Dm are applied with the white level voltage during the sustain period in the line inversion such that the deterioration of the image quality due to the leakage current in the switching transistor M1 may be reduced.

For the liquid crystal display (LCD) driven by the line inversion, the operation of the pixel is described in the sustain period of the positive line and the negative line. In this embodiment, the gate-off voltage Voff of the switching transistor M1 applied to the scan lines S1-Sn is −7V, the compensation voltage Vcompen applied to the compensating lines C1-Cn is −7V, and the common voltage Vcom is 0V. Here, the operation of the pixel in the black state in the sustain period of the positive line may be the same as or similar to the embodiment of FIG. 15, and the operation of the pixel in the white state in the sustain period of the positive line may be the same as or similar to the embodiment of FIG. 17. The operation of the pixel in the white state is described in the sustain period of the negative line.

Figure 19:
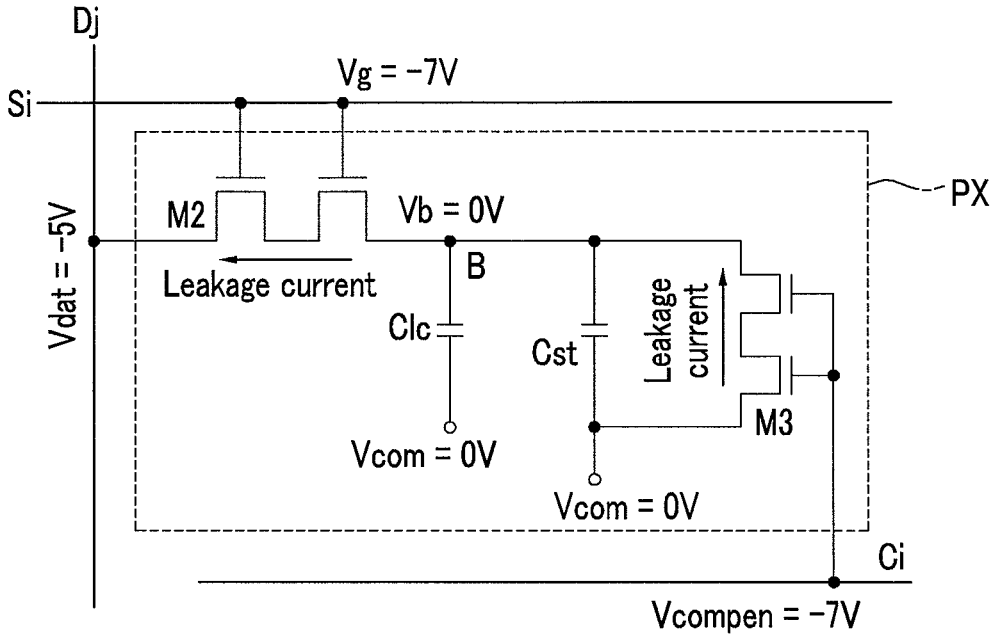
FIG. 19 is a circuit diagram of one pixel in a black state during a sustain period of the negative frame for the liquid crystal display (LCD) of FIG. 12, driven by line inversion.

FIG. 19 is a circuit diagram of one pixel in a black state during a sustain period of the negative line for the liquid crystal display (LCD) of FIG. 12, driven by line inversion.

Referring to FIG. 19, in the negative line, the common voltage Vcom is 0V, and the voltage Vb of the node B of the pixel PX of the black state is 0V. During the sustain period, the scan line Si is applied with the gate-off voltage Voff of −7V, the data line Dj is applied with the data voltage Vdat of −5V as the low white level voltage, and the compensating line Ci is applied with the compensation voltage Vcompen of −7V.

The voltage of the data line Dj is −5V, and the voltage Vb of the node B is 0V such that the voltage difference between the input terminal and the output terminal of the switching transistor M2 is 5V. Accordingly, the leakage current may flow toward the input terminal from the output terminal of the switching transistor M2 because of the voltage difference. The voltage Vb of the node B may be decreased by the leakage current flowing in the switching transistor M2, however, if the voltage Vb of the node B is low, the leakage current toward the compensation transistor M3 from the other terminal thereof is generated. Accordingly, the leakage current flowing in the switching transistor M2 is compensated by the leakage current flowing in the compensation transistor M3.

As described above, when the white level voltage is applied to the plurality of data lines D1-Dm during the sustain period of the negative line or the positive line, the leakage current that may flow in the pixel PX in the black state is compensated such that the image quality deterioration by the leakage current may be reduced.

Figure 20:
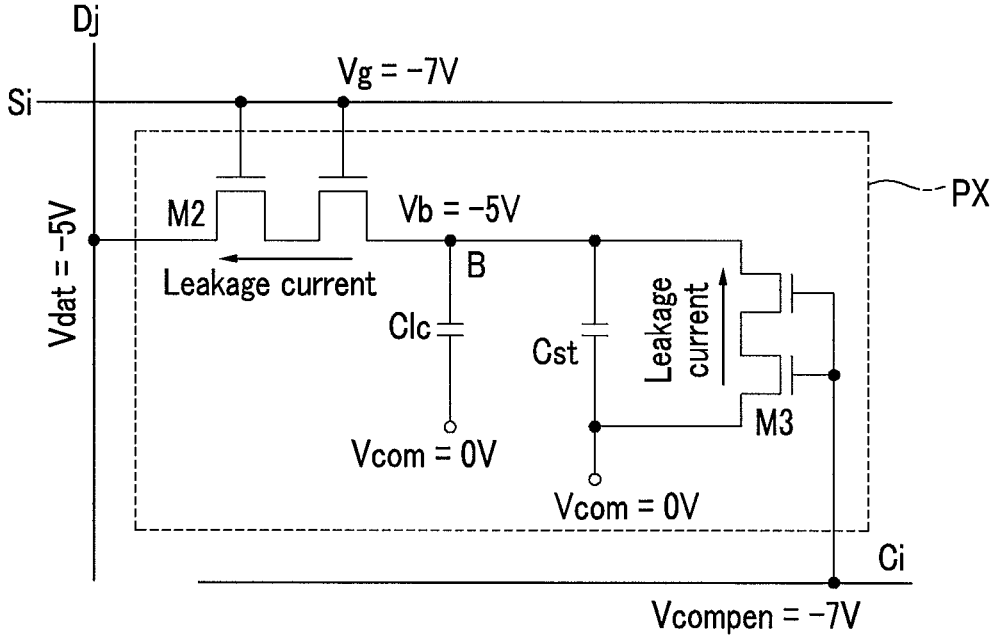
FIG. 20 is a circuit diagram of one pixel in a white state during a sustain period of the negative frame for the liquid crystal display (LCD) of FIG. 12, driven by line inversion.

FIG. 20 is a circuit diagram of one pixel in a white state during a sustain period of a negative frame for the liquid crystal display (LCD) of FIG. 12, driven by line inversion.

Referring to FIG. 20, in the negative frame, the common voltage Vcom is 0V, and the voltage Vb of the node B of the pixel PX of the white state is −5V. During the sustain period, the scan line Si is applied with the gate-off voltage Voff of −7V, the data line Dj is applied with the data voltage Vdat of −5V as the low white level voltage, and the compensating line Ci is applied with the compensation voltage Vcompen of −7V.

The voltage of the data line Dj and the voltage Vb of the node B are equal to each other as −5V such that the voltage difference between the input terminal and the output terminal of the switching transistor M2 is 0V. Meanwhile, the voltage difference between one terminal and the other terminal of the compensation transistor M3 is 5V. Accordingly, the leakage current may flow toward one terminal of the compensation transistor M3 from the other terminal thereof because of the voltage difference. The voltage Vb of the node B may be, increased by the leakage current flowing in the compensation transistor M3, however if the voltage Vb of the node B is high, the leakage current toward the data line Dj from the node B is generated in the switching transistor M2. Accordingly, the leakage current flowing in the compensation transistor M3 is compensated by the leakage current flowing in the switching transistor M2.

As described above, when the white level voltage is applied to the plurality of data lines D1-Dm during the sustain period of the positive line or the negative line, the leakage current corresponding to the leakage current flowing in the compensation transistor M3 in the pixel PX in the white state flows in the switching transistor M2 and is compensated such that the image quality deterioration by the leakage current may be reduced.

As above described, the liquid crystal display (LCD) is driven by the frame inversion and the column inversion. Other inversions such as a row inversion or a dot inversion may be implemented similarly to the above described frame inversion and column inversion.

As described above, after the plurality of pixels PX are applied with the data signal, the plurality of data lines D1-Dm are applied with the predetermined voltage such as the voltage opposite the common voltage Vcom or the white level voltage during the sustain period such that the influence of the leakage current in the pixel PX may be minimized. If the influence of the leakage current flowing in the pixel PX is decreased, the refresh rate of the liquid crystal display (LCD) may be reduced. In some embodiments, the electrical capacitance of the sustain capacitor Cst of the pixel PX is increased such that the refresh rate of the liquid crystal display (LCD) may be decreased. Accordingly, the power consumption of the liquid crystal display (LCD) may be reduced.

While various aspects have been described in connection with what is presently considered to be practical exemplary embodiments, it is to be understood that the invention is not limited to the disclosed embodiments, but, on the contrary, is intended to cover various modifications and equivalent arrangements.

What is claimed is:

1. A liquid crystal display (LCD), comprising:

a liquid crystal panel including a plurality of pixels configured to be driven during a scan period with data voltages, wherein during a sustain period the pixels are configured to emit light according to the data voltages;

a data driver configured to apply the data voltages to a plurality of data lines connected to the plurality of pixels; and a scan driver configured to apply scan controlling the input of the data voltages, wherein the pixels are configured to receive a common voltage during the sustain period, and wherein the data driver is configured to apply the data voltages to the data lines during the scan period, and to apply an opposite voltage to the data lines during the sustain period, wherein the opposite voltage is defined as a selected one of the data voltages having the largest difference from the common voltage.

2. The liquid crystal display (LCD) of claim 1, wherein the opposite voltage is less than the common voltage.

3. The liquid crystal display (LCD) of claim 1, wherein the opposite voltage is greater than the common voltage.

4. The liquid crystal display (LCD) of claim 1, wherein the common voltage has a voltage of one of a low level and a high level, wherein the common voltage has the low level in a positive frame in which the on data voltage is greater than the common voltage, and wherein the common voltage has the high level in a negative frame in which the on data voltage is less than the common voltage.

5. The liquid crystal display (LCD) of claim 4, wherein the opposite voltage is the voltage of the high level of the common voltage during the sustain period of positive frames.

6. The liquid crystal display (LCD) of claim 4, wherein the opposite voltage is the voltage of the low level of the common voltage during the sustain period of negative frames.

7. The liquid crystal display (LCD) of claim 1, wherein each of the plurality of pixels include:

a liquid crystal capacitor including a pixel electrode and a common electrode;

a switching transistor including a gate terminal connected to a scan line configured to receive the scan signals, an input terminal connected to a data line configured to receive the data voltages, and an output terminal connected to the pixel electrode of the liquid crystal capacitor; and a sustain capacitor including one terminal connected to the pixel electrode and another terminal connected to a wire transmitting the common voltage.

8. The liquid crystal display (LCD) of claim 1, further comprising a compensation voltage unit applying a compensation voltage to the plurality of pixels to compensate a leakage current.

9. The liquid crystal display (LCD) of claim 8, wherein the plurality of pixels include:

a liquid crystal capacitor including a pixel electrode and a common electrode;

a switching transistor including a gate terminal connected to a scan line configured to receive the scan signals, an input terminal connected to a data line configured to receive the data voltages, and an output terminal connected to the pixel electrode of the liquid crystal capacitor;

a sustain capacitor including one terminal connected to the pixel electrode and another terminal connected to a wire transmitting the common voltage; and a compensation transistor configured to generate a compensation current to compensate for leakage current in the switching transistor.

10. The liquid crystal display (LCD) of claim 9, wherein the compensation transistor includes:

a gate terminal connected to a compensating line configured to receive the compensation voltage;

one terminal connected to one terminal of the sustain capacitor; and the other terminal connected to a common voltage.

11. The liquid crystal display (LCD) of claim 10, wherein the compensation voltage is a gate-off voltage configured to turn off the compensation transistor.

12. The liquid crystal display (LCD) of claim 11, wherein the compensation voltage is the same voltage as a gate-off voltage turning off the switching transistor.

13. A method of driving a liquid crystal display (LCD), the method comprising:

during a scan period, applying data voltages to a plurality of data lines connected to a plurality of pixels;

during a sustain period, emitting light with the pixels according to the data voltages;

during the scan period and sustain period, applying a common voltage to the pixels; and during the sustain period, applying an opposite voltage to the plurality of data lines, wherein the opposite voltage is defined as a selected one of the data voltages having the largest difference from the common voltage.

14. The method of claim 13, wherein each data voltage comprises voltage levels which are greater than the common voltage or voltage levels which are less than the common voltage.

15. The method of claim 14, wherein during at least the sustain period of a positive frame in which the data voltage comprises voltage levels greater than the common voltage, the opposite voltage is greater than the common voltage.

16. The method of claim 15, wherein the common voltage is a low level in the positive frame.

17. The method of claim 14, wherein during at least the sustain period of a negative frame in which the data voltage comprises voltage levels less than the common voltage, the opposite voltage is less than the common voltage.

18. The method of claim 17, wherein the common voltage is a high level in the negative frame.

19. The method of claim 13, wherein, during the scan period, the data voltages include a voltage level greater than the common voltage that is applied to one data line, and the data voltages include a voltage level less than the common voltage that is applied to an adjacent data line.

20. The method of claim 19, wherein during the sustain period of a positive line in which the data voltage comprising voltage levels greater than the common voltage, the opposite voltage is greater than the common voltage.

21. The method of claim 19, wherein during the sustain period of a negative line in which the data voltage comprising voltage levels less than the common voltage, the opposite voltage is less than the common voltage.

* * * * *